US010590652B2

(12) United States Patent
Dye et al.

(10) Patent No.: US 10,590,652 B2
(45) Date of Patent: Mar. 17, 2020

(54) DRIP EDGE

(71) Applicant: James Hardie Technology Limited, Dublin (IE)

(72) Inventors: Thayne Dye, Upland, CA (US); Jeremy Gearheart, Thompson's Station, TN (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/181,049

(22) Filed: Nov. 5, 2018

(65) Prior Publication Data

US 2019/0071873 A1 Mar. 7, 2019

Related U.S. Application Data

(63) Continuation-in-part of application No. 15/920,204, filed on Mar. 13, 2018.

(60) Provisional application No. 62/471,255, filed on Mar. 14, 2017.

(51) Int. Cl.
*E04D 13/04* (2006.01)
*E04D 13/15* (2006.01)

(52) U.S. Cl.
CPC ..... *E04D 13/0459* (2013.01); *E04D 13/15* (2013.01); *E04D 2013/0468* (2013.01)

(58) Field of Classification Search
CPC ..... E04D 13/0459; E04D 2013/0468; E04D 13/076; E04D 13/158; E04D 13/15
See application file for complete search history.

(56) References Cited

U.S. PATENT DOCUMENTS

| | | | | |
|---|---|---|---|---|
| 4,081,657 | A | 3/1978 | Stanford | |
| 6,912,813 | B2 * | 7/2005 | Grizenko | E04D 3/40 49/471 |
| 10,072,422 | B2 | 9/2018 | Casey | |
| D829,928 | S * | 10/2018 | Dye | D25/48.2 |
| 2005/0005551 | A1 | 1/2005 | Graham | |
| 2008/0196321 | A1 * | 8/2008 | Kronemeyer | E04D 13/0459 52/60 |
| 2016/0168859 | A1 | 6/2016 | Vargas | |
| 2018/0266115 | A1 * | 9/2018 | Dye | E04D 13/0459 |
| 2019/0071873 | A1 * | 3/2019 | Dye | E04D 13/0459 |

* cited by examiner

*Primary Examiner* — Andrew J Triggs
(74) *Attorney, Agent, or Firm* — Knobbe Martens Olson & Bear, LLP

(57) ABSTRACT

A customizable roof drip edge system includes an inner footing, an outer section, and a tail integrally formed with the inner footing and the outer section. The tail is nailable to a roof substrate. The outer section includes a bridging member connecting the tail to an outer footing. The bridging member and the outer footing are configured for directing the flow of water off of a roof. The inner footing is spaced from the outer footing by a suitable distance and configured to be placed against an eave as a positioning aid such that the drip edge can easily and reliably be installed with sufficient spacing for the installation of a fascia board after installation of the drip edge. The drip edge may be bendable to user-selectable angles between the tail and the inner footing and outer section to accommodate a range of roof pitches.

13 Claims, 28 Drawing Sheets

DRIP EDGE

CROSS-REFERENCE TO RELATED APPLICATIONS

This application is a continuation-in-part of U.S. patent application Ser. No. 15/920,204, filed Mar. 13, 2018, entitled "DRIP EDGE," which claims the benefit of U.S. Provisional Application Ser. No. 62/471,255, filed Mar. 14, 2017, entitled "DRIP EDGE," both of which are hereby incorporated by reference in their entirety and for all purposes.

BACKGROUND

Field

The present disclosure generally relates to weather resistant barrier systems, and more specifically to drip edge systems and methods.

Description of the Related Art

A drip edge can be installed at roof edges to guide water runoff away from fascia boards along roof linings and/or otherwise improve water management properties of the roof. The drip edge is typically a sheet of elongate metal bent across its length. The upper portion of the drip edge is inserted under the first course of roof shingles and attached to the roof while the lower portion extends downwardly from the edge of the roof to protect the fascia from roof runoff. Because the fascia boards are often installed after roofing is completed, drip edges are sometimes positioned too close to the eaves without leaving sufficient space for the fascia board to be installed behind the drip edge. The effectiveness of a drip edge may also be affected by the pitch of the roof. Drip edges designed for flat roofs do not function properly when installed on a high pitch roof and vice versa.

SUMMARY

The systems, methods, and devices described herein address one or more problems as described above and associated with current runoff water management systems. The systems, methods and devices described herein have innovative aspects, no single one of which is indispensable or solely responsible for their desirable attributes. Without limiting the scope of the claims, the summary below describes some of the advantageous features.

The present disclosure provides various embodiments of a universal drip edge that can be effectively installed and used to protect fascia boards from roof water runoff regardless of the roof pitch. The present disclosure also provides various embodiments of a drip edge that can be reliably installed on roofs with sufficient room for a fascia board despite being installed before the fascia is attached. The present disclosure also provides various embodiments of a drip edge configured to facilitate water coalescing so that scattering or splashing of roof runoff is significantly reduced. In some embodiments, the drip edge has an inner footing and an outer section that may be independently angled relative to a tail of the drip edge. The drip edge has a double-layer tail that may provide a more robust product for installation and long-term performance following installation.

In one embodiment, the drip edge is configured to be installed to a substantially planar roof substrate comprising an upper surface and a side-facing surface. The drip edge comprises a tail extending along the length of the drip edge, the tail comprising an upper layer having a lower end and an upper end, and a lower layer having a lower end and an upper end, wherein the upper end of the lower layer is contiguous with the upper end of the upper layer, and wherein the drip edge is coupleable to the upper surface of the roof substrate by driving one or more mechanical fasteners through the tail such that lower layer lies adjacent to the upper surface of the roof substrate; an inner footing contiguous with the lower end of the lower layer at a lower lengthwise joint, the inner footing extending along the length of the drip edge, wherein an inner surface of the inner footing lies adjacent to the side-facing surface of the roof substrate; and an outer section contiguous with the upper layer at an upper lengthwise joint defining a roof angle corresponding to a roof pitch of the roof substrate, the outer section extending along the length of the drip edge. The outer section comprises a bridging member having a proximal end adjacent to the second lengthwise joint and a distal end opposite the proximal end, and an outer footing contiguous with the distal end of the bridging member, the outer footing extending parallel to the inner footing to form a downward-facing c-shaped channel with the inner footing and the bridging member. The c-shaped channel is sized and shaped to accommodate installation of a fascia board having a substantially rectangular cross-section disposed at least partially within the c-shaped channel and fastened to the side-facing surface of the roof substrate. The tail is configured to accommodate installation of a roofing material coupled to the upper surface of the roof substrate wherein at least a portion of the roofing material lies adjacent to the upper surface and at least a portion of the roofing material lies adjacent to the tail of the drip edge such that at least a portion of the tail of the drip edge is disposed between the upper surface of the roof substrate and an underside of the roofing material.

In some embodiments, the upper layer of the tail, the lower layer of the tail, the inner footing, the bridging member, and the outer footing each comprise 23 gauge sheet aluminum.

In some embodiments, the outer footing of the drip edge comprises a top end contiguous with the bridging member and a bottom end opposite the top end, the bottom end comprising a lip extending outwardly at an angle of greater than 0 degrees and not more than 60 degrees relative to the outer footing such that a liquid flowing downward along the outer footing is directed away from the fascia board.

In some embodiments, the lip extends outwardly at an angle of greater than 15 degrees and not more than 45 degrees.

In some embodiments, the lip comprises a double layer having a thickness greater than a thickness of the outer footing.

In some embodiments, the drip edge comprises a plurality of adjacent discrete drip edge sections having substantially identical cross sections, the drip edge sections disposed adjacently to form a drip edge extending along substantially the entire length of roof substrate.

In some embodiments, the c-shaped channel has a width of between 0.75 inch and 1.25 inch.

In some embodiments, the c-shaped channel is sized and shaped to allow a fascia board to be installed to the roof substrate after the drip edge is installed to the roof substrate.

In another embodiment, a universal drip edge is described. The universal drip edge comprises a tail extending along the length of the drip edge, the tail comprising a lower layer and an upper layer contiguous with the lower layer at an upper end of the tail; an inner footing extending along the length of the drip edge and contiguous with the lower layer at a lower end of the tail; and an outer section extending along the length of the drip edge. The outer section comprises a bridging member having a proximal end contiguous with the upper layer at the lower end of the tail to define a roof angle, and an outer footing parallel to the inner footing and contiguous with a distal end of the bridging member opposite the proximal end. The roof angle is selectable by bending at least one of the inner footing and the bridging member relative to the tail. The inner footing comprises an inner surface proximate the lower layer, the inner surface configured to be placed against an end surface of a roof substrate to define a drip edge installation position. The bridging member, the inner footing, and the outer footing define a downward-facing channel configured to receive and partially surround a fascia board.

In some embodiments, the bridging member meets the upper layer of the tail along a bendable upper angled joint.

In some embodiments, the inner footing meets the lower layer of the tail along a bendable lower angled joint.

In some embodiments, a lower angle between the inner footing and the lower layer of the tail is adjustable, and wherein an upper angle between the bridging member and the upper layer of the tail is adjustable independently of the lower angle.

In some embodiments, the bridging member and the upper layer of the tail define an upper angled joint having an angle of between 135 degrees and 180 degrees.

In some embodiments, the tail is configured to receive one or more mechanical fasteners for securing the drip edge to a roof substrate.

In some embodiments, the outer footing comprises a top end contiguous with the bridging member and a bottom end opposite the top end, the bottom end comprising a lip disposed at an angle relative to the outer footing.

In some embodiments, the bottom end comprises a double layer terminating in a joint.

In some embodiments, the inner footing, the outer section, and the tail comprise aluminum.

In some embodiments, the outer section and the tail are manufactured by bending to form an integral drip edge system.

In some embodiments, the aluminum is sheet aluminum having a thickness not greater than 21 gauge and not less than 26 gauge.

In some embodiments, the outer footing is configured to accommodate and direct a flow of water received from a roof.

In some embodiments, the c-shaped channel is sized and shaped to allow a fascia board to be installed to the roof substrate after the drip edge is installed to the roof substrate.

In another a method of manufacturing an integrally formed drip edge comprises obtaining a metal sheet defined by a length and a width shorter than the length, the width extending between a first lengthwise edge and a second lengthwise edge opposite the first lengthwise edge; bending the metal sheet lengthwise at a first location spaced from the first lengthwise edge along the width by a first distance corresponding to an inner footing length of the drip edge; bending the metal sheet lengthwise at a second location between the first location and the second lengthwise edge, the second location spaced from the first location along the width by a second distance corresponding to a tail width of the drip edge; bending the metal sheet lengthwise at a third location between the second location and the second lengthwise edge, the third location spaced from the second location along the width by the second distance; bending the metal sheet lengthwise at a fourth location between the third location and the second lengthwise edge, the fourth location spaced from the third location along the width by a third distance corresponding to a channel width of the drip edge; and bending the metal sheet lengthwise at a fifth location between the fourth location and the second lengthwise edge, the fifth location spaced from the fourth location along the width by a fourth distance corresponding to an outer footing length of the drip edge.

In some embodiments, after bending, the portion of the metal sheet between the first lengthwise edge and the first location comprises an inner footing, the portion of the metal sheet between the first location and the second location comprises a lower layer of a tail, the portion of the metal sheet between the second location and the third location comprises an upper layer of the tail adjacent to the lower layer, the portion of the metal sheet between the third location and the fourth location comprises a bridging member, the portion of the metal sheet between the fourth location and the fifth location comprises an outer footing defining a c-shaped channel with the bridging member and the inner footing, and the portion of the sheet metal between the fifth location and the second lengthwise edge comprises an angled section.

In some embodiments, the method further comprises bending the metal sheet lengthwise at a sixth location between the fifth location and the second lengthwise edge to form a double-layer angled section.

In some embodiments, the metal sheet comprises sheet aluminum having a thickness not greater than 21 gauge and not less than 26 gauge.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1A:
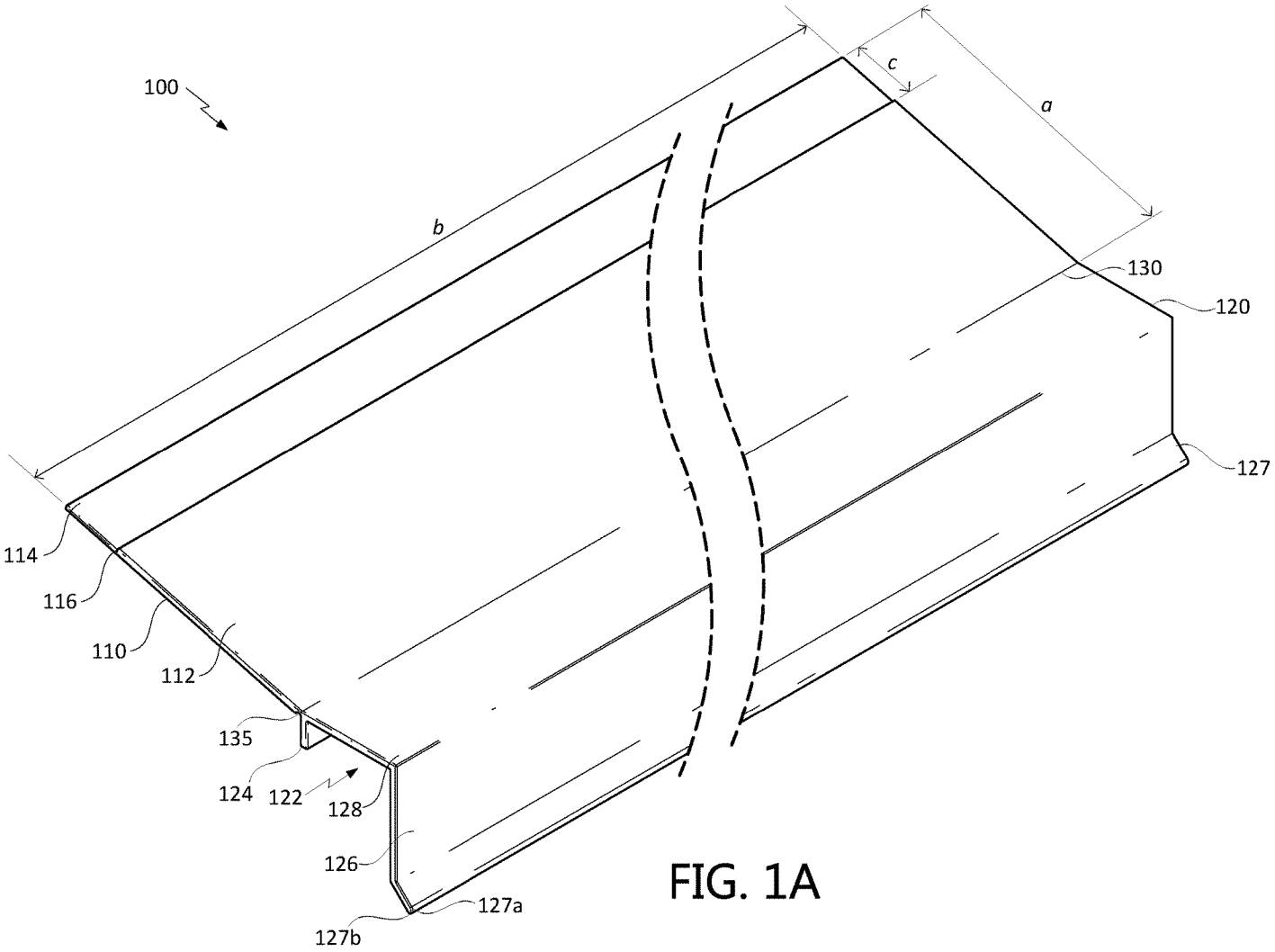
FIG. 1A is an isometric perspective view of a roof drip edge in accordance with an example embodiment.
Figure 1B:
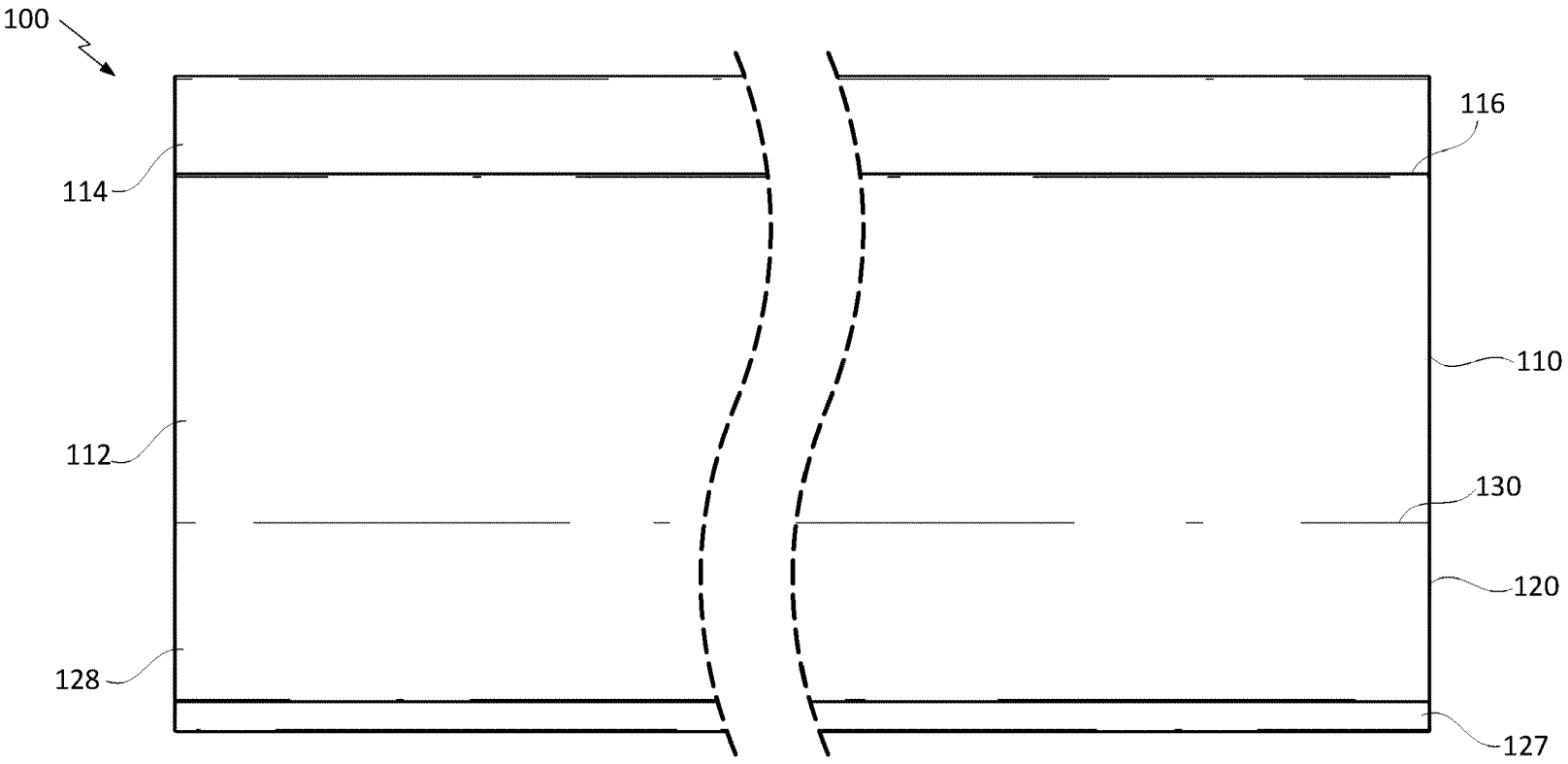
FIG. 1B is a top view of the roof drip edge of FIG. 1A.
Figure 1C:
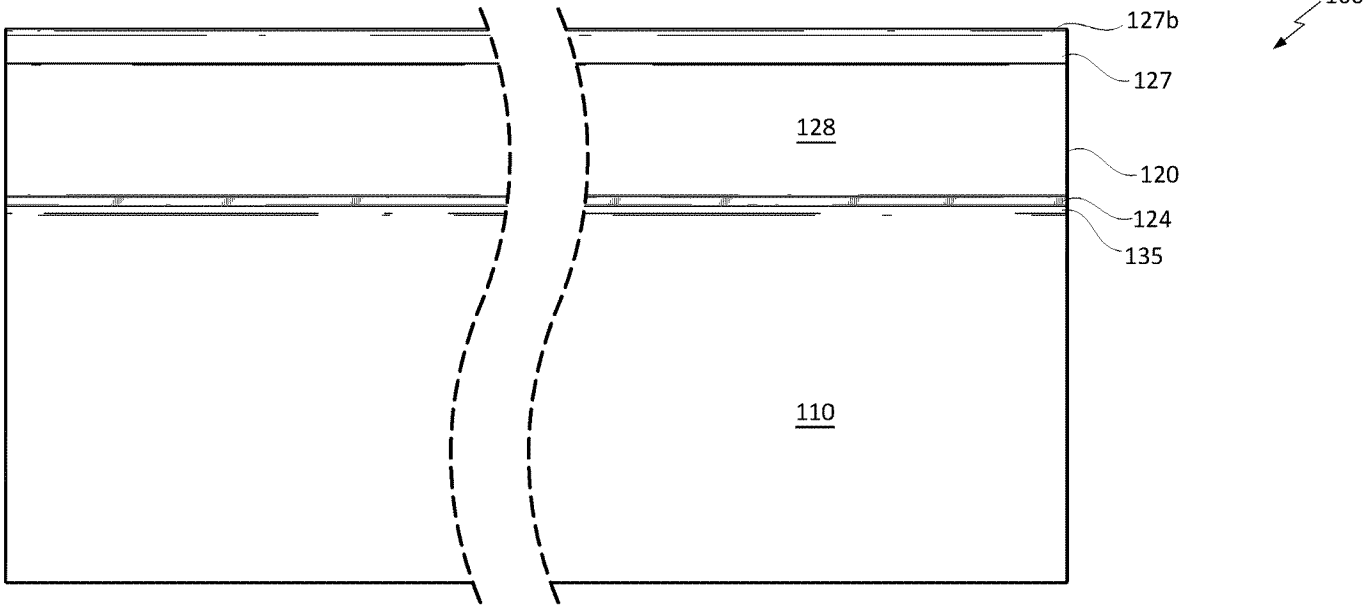
FIG. 1C is a bottom view of the roof drip edge of FIGS. 1A and 1B.

Although the present disclosure is described with reference to specific examples, it will be appreciated by those skilled in the art that the present disclosure may be embodied in many other forms. The embodiments discussed herein are merely illustrative and do not limit the scope of the present disclosure.

In the description which follows, like parts may be marked throughout the specification and drawings with the same or similar reference numerals. The drawing figures are not necessarily to scale and certain features may be shown exaggerated in scale or in somewhat generalized or schematic form in the interest of clarity and conciseness.

Generally described, this disclosure describes improved roof drip edges providing a variety of possible advantages over existing flashing systems. As will be described with reference to the figures, in some embodiments the drip edges described herein are advantageously configured to be installed by roofers so as to reliably provide sufficient space for a fascia board to be attached to the eave by a cladding installer. In certain aspects, the drip edges described herein may be structurally robust while being nailable to a roof sheathing or other building substrate. In a further advantage, some embodiments may be configured to be bendable at one or more bending locations and/or along one or more bending axes, such that identically manufactured drip edges may be customizable by an installer for use with roofs having different pitches.

Some embodiments described herein may advantageously be formed from relatively thin sheet metal such that the drip edges can be bent at a plurality of locations along the drip edge profile, while including a double-layer tail section which may advantageously strengthen one or more attachment points between the drip edge and a building substrate. An upper layer of the tail may be contiguous with an outer section of the drip edge, while a lower layer of the tail may be contiguous with an inner footing of the drip edge, such that the angles of the inner footing and the outer section relative to the tail may be independently selected and/or adjusted. Moreover, various embodiments described herein may be adaptable to provide suitable drainage functionality for a wide range of roof pitch angles. These and other advantages of various embodiments will be apparent from the description that follows.

FIGS. 1A-1D depict an example configuration of a drip edge 100 or section thereof in accordance with an example embodiment. The drip edge 100 includes an inner tail 110 and an outer section 120. The tail 110 includes a lower section 112 and an upper section 114 relatively thinner than the lower section 112, divided from the lower section 112 at an interface 116. The outer section 120 includes a c-shaped channel 122, defined generally by an inner footing 124, an outer footing 126, and a bridging member 128 disposed between the inner and outer footings 124, 126. The tail 110 is contiguous with the outer section 120 at an angled joint 130.

The drip edge 100 can comprise a metal, for example, aluminum, steel, or other suitable metal. The drip edge 100 can be formed in the profile depicted in FIG. 1D by any suitable metal working method, for example, extruding, rolling, bending, molding, or the like. In some embodiments, the drip edge 100 is made of extruded aluminum. Structural strength may be provided by using a relatively thick metal, for example, as compared to the thickness of conventional drip edge flashing. For example, the drip edge 100 depicted in FIGS. 1A-1D has a thickness of approximately 1/16" (1.5875 mm) along the lower section 112 of the tail 110, and at the outer section 120. In other embodiments, the thickness of the drip edge 100 can be any suitable range, such as between 1/64" and 1/8" (between 0.396875 mm and 3.175 mm), between 1/32" and 1/16" (between 0.79375 mm and 1.5875 mm), or the like.

The drip edge 100 can be made in various sizes. For example, the width a of the tail (e.g., the distance between the angled joint 130 and a distal end of the tail 110) can be any suitable distance such as 2 inches (5.08 cm), 3 inches (7.62 cm), or longer. In another example, the length b of the drip edge 100 (e.g., the length of the drip edge 100 along the angled joint 130) can be less than 1 foot (less than 0.3048 m), 1 foot (0.3048 m), 2 feet (0.6096 m), 5 feet (1.524 m), 10 feet (3.048 m), or longer. In some embodiments, the drip edge 100 can be manufactured in a first length b which can be cut down to a shorter custom length by a drip edge installer based on the length of a section of roof edge to be covered. Where a relatively long roof edge is to be covered, a plurality of sections of drip edge 100 can be placed end-to-end to achieve a longer drip edge system. It will be appreciated that the various functions and advantages of the drip edges described herein can be achieved with relatively short and/or long drip edge sections.

To facilitate nailing of the relatively thick drip edge 100 to a roof sheathing or other building substrate, the upper section 114 of the tail 110 is relatively thinner than the lower section 112. In various embodiments the thickness of the upper section 114 can be thinner than the lower section 112 by approximately 10%, 25%, 40%, 50%, 75%, or any other suitable percentage or range of percentages, such as between 25% and 50%. For example, the upper section 114 of the tail 110 of the drip edge 100 is approximately 0.04 inches (1.016 mm) thick, approximately 36% thinner than the lower section 112. The thickness of the upper section 114 of the tail can be selected so as to be thin enough to be easily securable to a substrate by nails or other mechanical fasteners, and thick enough to retain a desired structural rigidity. The width c of the upper section 114 can be any suitable width. In some embodiments, the width c of the upper section 114 is selected so as to provide a sufficiently large thin area to receive one or more mechanical fasteners, without significantly reducing the strength or dimensional stability of the drip edge 100. For example, in some embodiments, the width c of the upper section 114 is between 0.375 inches (9.525 mm) and 0.75 inches (19.05 mm). In one embodiment, the width c of the upper section is approximately 0.44 inches (11.176 mm).

The interface 116 between the upper section 114 and lower section 112 of the tail 110 can be a stepwise transition between the two metal thicknesses, or can be chamfered to provide a more gradual transition between the thickness of the upper section 114 and the thickness of the lower section 112. In the example drip edge 100 of FIG. 1D, the interface 116 is a stepwise transition. The angle of the chamfer can be selected so as to prevent the pooling of water behind the interface 116. For example, the chamfer angle may be approximately equal to or greater than the angle of the joint 130 such that the surface of the interface 116 is downward-sloping when installed on an angled building surface.

The outer section 120 of the drip edge 110 is configured to extend and carry draining water away from an edge of a roof surface. The inner footing 124 extends downward from the bridging member 128 to serve as a guide for placement of the drip edge 100 against an eave of a roof. In various embodiments, the length of the inner footing 124 can be any suitable length such as between 0.1" and 1" (between 2.54 mm and 25.4 mm), between 0.1" and 0.5" (between 2.54 mm and 12.7 mm), or the like. For example, the inner footing 124 of the drip edge 100 is approximately 0.25" (6.35 mm). In some embodiments, the inner footing may be substantially longer than 1" (25.4 mm).

The outer footing 126 is longer than the inner footing so as to guide draining water to a height substantially lower than the top edge of a fascia board installed within the c-shaped channel 122. In various embodiments, the length of the outer footing 126 can be any suitable length such as between 0.5" and 6" (between 12.7 mm and 152.4 mm), between 1" and 5" (between 25.4 mm and 127 mm), or the like. For example, the outer footing 126 of the drip edge 100 is approximately 1.25" (31.75 mm).

At least a portion of the outer footing 126 can be an angled section 127 or lip configured to further guide water away from the roof edge. The angled section 127 is located at a distal end of the outer footing 126 and disposed at an angle relative to the vertically oriented proximal portion of the outer footing 126. In various embodiments the angle can be between 15 and 60 degrees so as to direct water away from the side of a building while continuing to facilitate the downward flow of water along the outer footing 126. For example, the angled portion 127 of the drip edge 100 depicted is angled at approximately 45 degrees relative to the remainder of the outer footing 126.

Figure 1D:
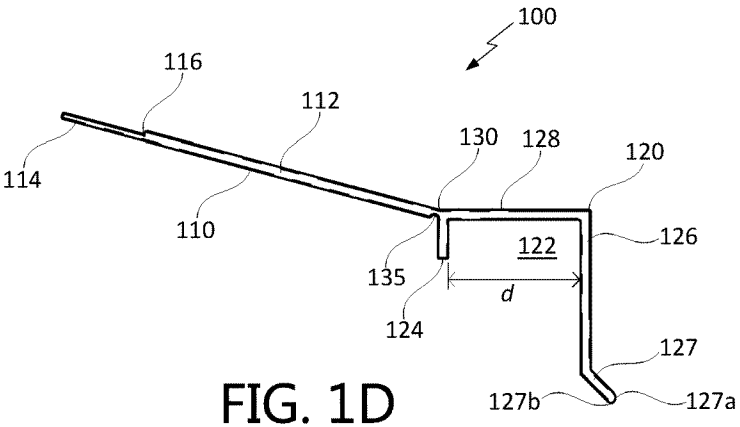
FIG. 1D is a side profile view of the roof drip edge of FIGS. 1A-1C.

In some embodiments, the end of the angled section 127 of the outer footing 126 is further shaped so as to facilitate the coalescence of water at the end of the drip edge 100. As shown in FIG. 1D, the angled section 127 terminates in an upper fillet 127*a* and a lower fillet 127*b*. The upper fillet 127*a* can have a larger radius of curvature than the lower fillet 127*b*. For example, the radius of curvature of the upper fillet 127*a* can be larger than the radius of curvature of the lower fillet 127*b* by a factor of 1.25, 1.5, 2, 3, or greater.

Thus, the inner footing 124, outer footing 126, and bridging member 128 define the c-shaped channel 122. The width d of the c-shaped channel 122 is defined by the length of the bridging member 128. In various embodiments, the width d of the c-shaped channel 122 can be any width in the range of approximately 0.5" (12.7 mm), 0.75" (19.05 mm), 1" (25.4 mm), or greater. In the drip edge 100 depicted in FIGS. 1A-1D, the width d of the c-shaped channel 122 is approximately 0.85" (21.59 mm). Preferably, the width of the c-shaped channel 122 is at least slightly larger than the thickness of a fascia board to be installed. For example, the 0.85" c-shaped channel 122 depicted in FIGS. 1A-1D is conveniently sized to accommodate a fascia board having a nominal thickness of 1 inch (e.g., dimensional lumber of nominal size 1×2, 1×4, 1×6, or the like, having an actual thickness of approximately 0.75" or 19 mm), with a tolerance of approximately 0.1" (2.54 mm).

A divot 135 is disposed along the lower surface of the tail 110 of the drip edge 100 behind the inner footing 124. The divot 135 is preferably located at or near the end of the tail 110, and may be directly adjacent to the inner footing 124. The divot 135 comprises a locally thinner region of the drip edge 100. For example, the divot 135 may be thinner than the adjacent portions of the drip edge 100 (e.g., the lower section 112 of the tail 110, the inner footing 124, and/or the bridging member 128) by approximately 10%, 25%, 40%, 50%, 75%, or any other suitable percentage. The thickness of the drip edge 100 at the divot 135 may be selected so as to be small enough to make the drip edge 100 locally bendable at the divot 135 along a bending axis parallel or substantially parallel to the length of the drip edge 100, while being large enough to provide a robust connection between the tail 100 and the outer section 120. Moreover, the divot 135 can facilitate bending of the drip edge 100 along a desired bending axis while preventing unwanted bending along other directions. In some embodiments, the thickness of the drip edge 100 at the divot 135 may be approximately equal to the thickness of the upper section 114 of the tail 110.

Referring now to FIGS. 2A-2D, a drip edge 200 is depicted as installed to a building substrate 250. The drip edge 200 installed in FIGS. 2A-2D can be any of the drip edges 100, 300, 400, 500, 600, 700, 800 depicted and described herein. The building substrate 250 can be an eave or a portion thereof, or any other upper structural portion of a building. For example, the building substrate 250 can include a rafter, a truss, or the like. In some embodiments, the substrate 250 is covered with a sheathing 255, such as oriented strand board, plywood, or the like. The substrate 250 and/or optional sheathing 255 can receive mechanical fasteners (e.g., nails or other fasteners) to secure the drip edge 200 and a roofing material 260 relative the substrate 250 and/or sheathing 255.

Figure 2A:
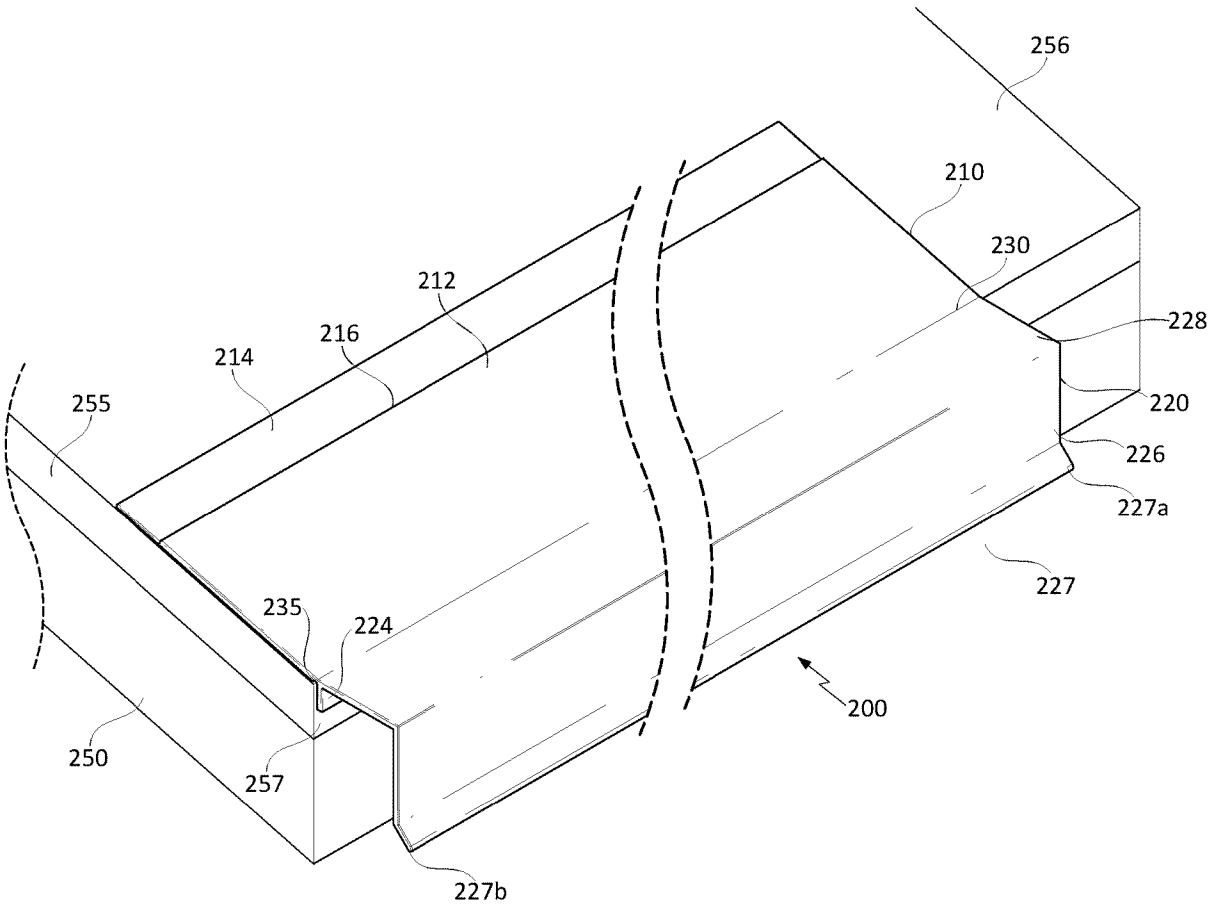
FIG. 2A is an isometric perspective view of an example configuration of the roof drip edge depicted in FIGS. 1A-1D installed on a roof sheathing.
Figure 2B:
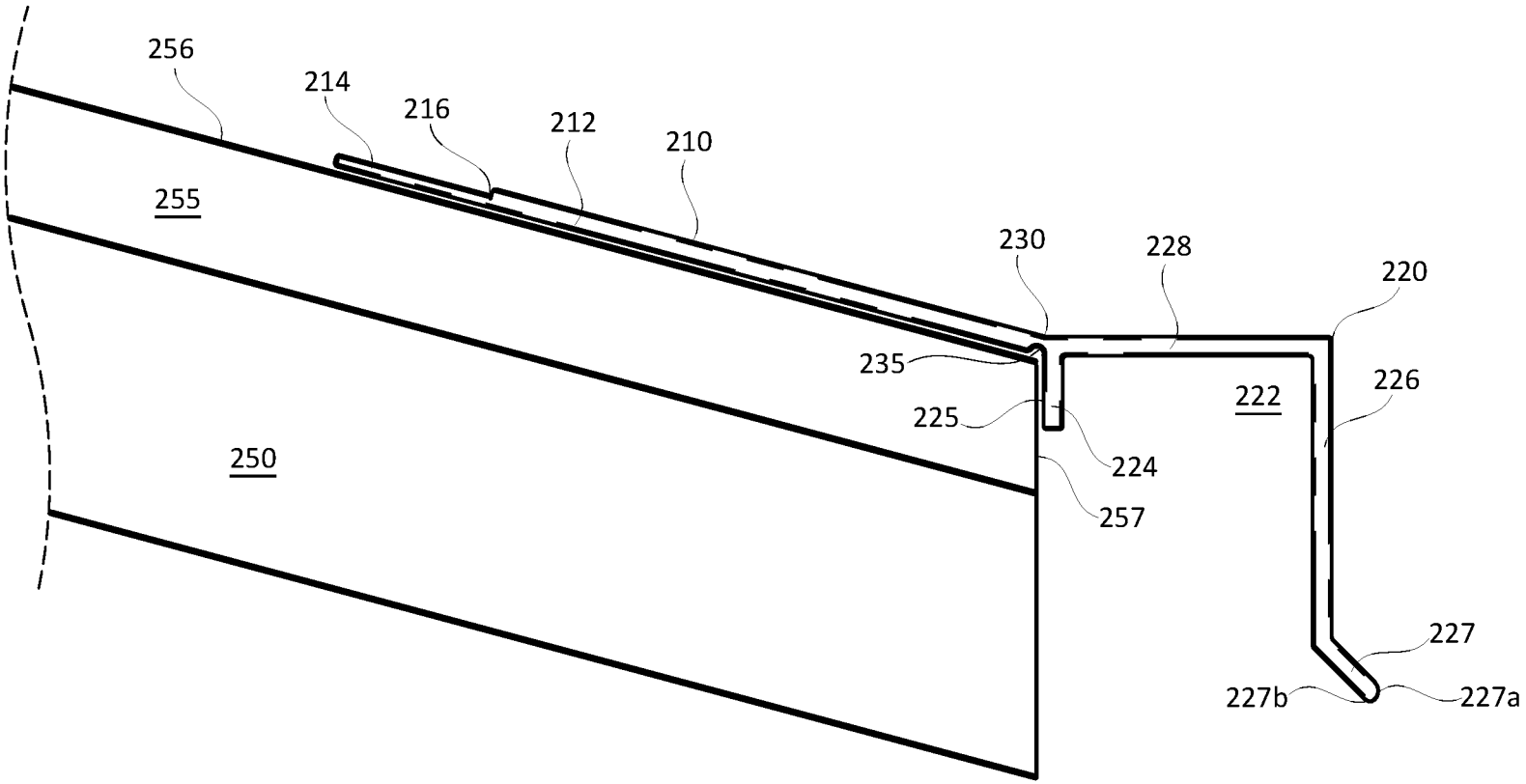
FIG. 2B is a side profile view of the installed configuration of FIG. 2A.

As shown in FIGS. 2A and 2B, the drip edge 200 can be secured to the sheathing 255 before a roofing material and fascia board (not shown in FIGS. 2A-2B) are installed. The drip edge 200 is positioned for installation by positioning the tail 210 against an upper surface 256 of the sheathing 255 or substrate 250 and positioning a back surface 225 of an inner footing 224 against a side-facing surface 257 of the sheathing 255 or substrate 250. When the drip edge 200 has been placed against the substrate 250 or sheathing 255, it can be secured in place by the use of mechanical fasteners, such as nails, which may be driven downward into the substrate 250 and/or sheathing 255 through the relatively narrow upper section 214 of the tail 210.

At any time before, during, or after installation of the drip edge 200 to the building substrate 250, the angle between the tail 210 and the outer section 220 can be adjusted based on the pitch of the roof by bending the drip edge 200 at the divot 235. For example, the angle can be adjusted such that, when the tail 210 is lying parallel to the sheathing 255, the bridging member 228 is oriented in a substantially horizontal direction and the inner and outer footings 224, 226 are oriented in a substantially vertical direction. The drip edge 200 may be bent at the divot 235 to the appropriate angle before installation based on a measurement of the pitch of the roof, or may be bent after installation based on an observed deviation from the desired final orientation of the outer section 220.

Figure 2C:
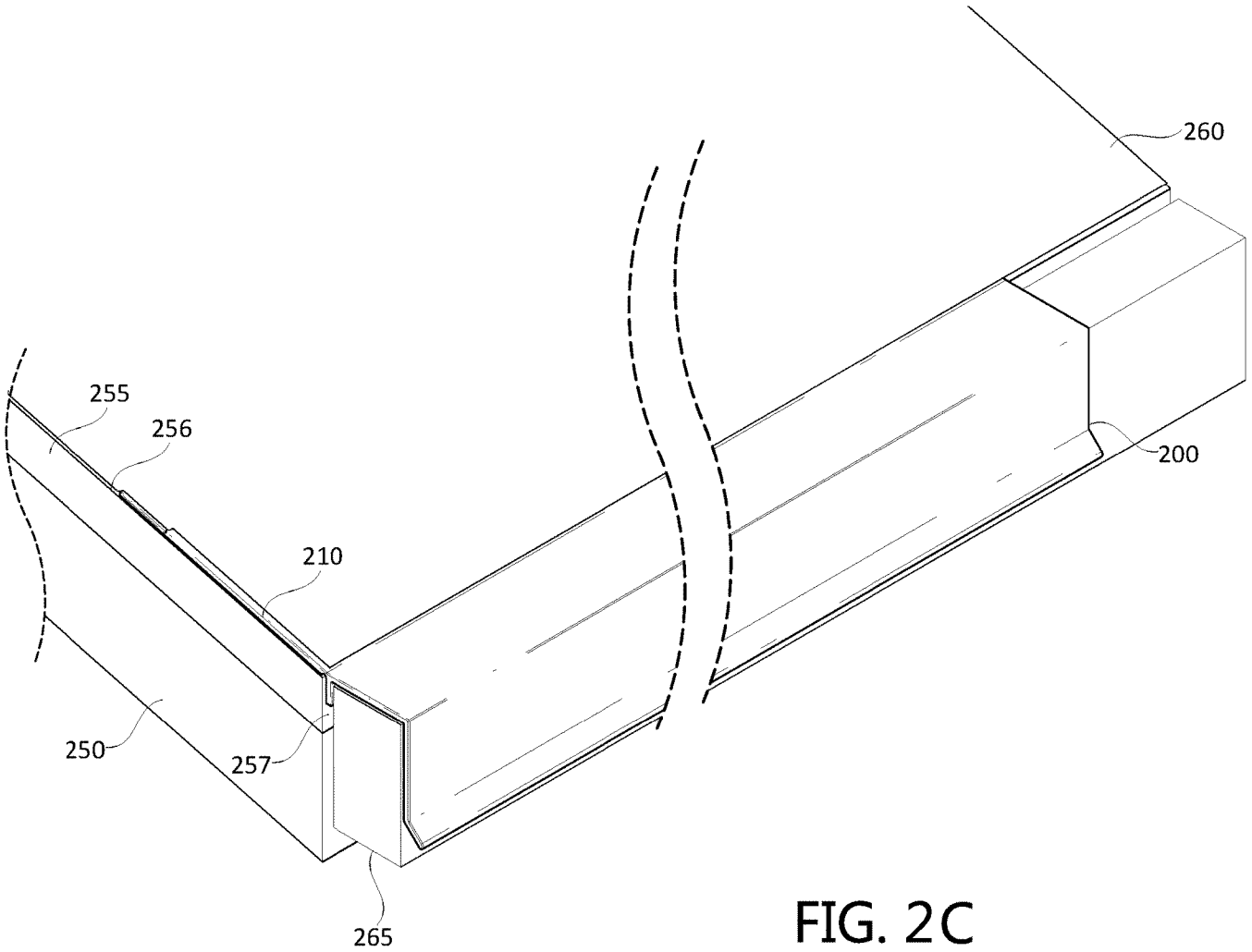
FIG. 2C is an isometric perspective view of the installed roof drip edge of FIGS. 2A and 2B after installation of roofing materials and a fascia.
Figure 2D:
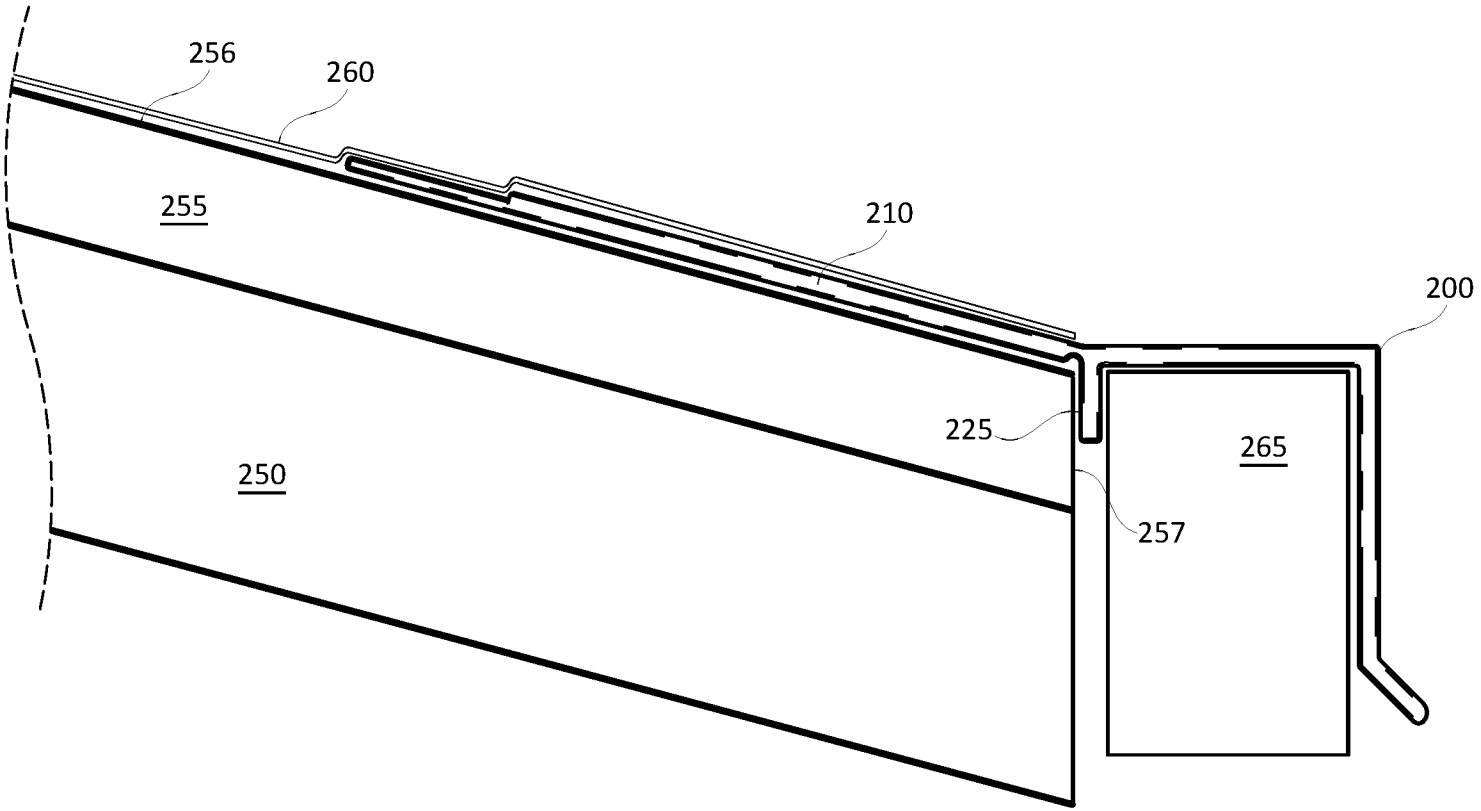
FIG. 2D is a side profile view of the installed configuration of FIG. 2C.

As shown in FIG. 2C and FIG. 2D, a roofing material 260 and a fascia board 265 can then be installed by securing to the substrate 250 and/or sheathing 255. The roofing material 260 can be any exterior roofing, for example, asphalt shingle, wood or other shingle, tile, membrane roofing, metal roofing, thatch, or the like. The roofing material 260 can be secured to the upper surface 256 by one or more mechanical fasteners such that the roofing material 260 at least partially covers the tail 210 of the drip edge 200, thereby directing water from the roof to be drained away from the building efficiently by the drip edge 200.

The fascia board 265, which can be wood, metal, plastic, or the like, is placed within the c-shaped channel 222 of the outer section 220 of the drip edge 200. The thickness of the fascia board 265 can be selected so as to fit within the c-shaped channel 222 of the drip edge 200. After the fascia board 265 is placed within the c-shaped channel 222, the fascia board 265 is secured to the side-facing surface 257 by one or more mechanical fasteners. In some aspects, the use of the inner footing 224 as a guide for positioning the drip edge 200 can thus allow a roofer to easily and efficiently install the drip edge 200 with sufficient space for the fascia board 265.

With reference to FIGS. 3A-8B, additional embodiments of the drip edges described herein will be described. Each embodiment of a drip edge 300, 400, 500, 600, 700, 800 depicted in FIGS. 3A-8B comprises a tail 310, 410, 510, 610, 710, 810, and an outer section 320, 420, 520, 620, 720, 820 including an inner footing 324, 424, 524, 624, 724, 824 and an outer footing 326, 426, 526, 626, 726, 826. Thus, drip edges 300, 400, 500, 600, 700, 800 can be installed to a building substrate in substantially the same manner as drip edges 100, 200 described above.

Figure 3A:
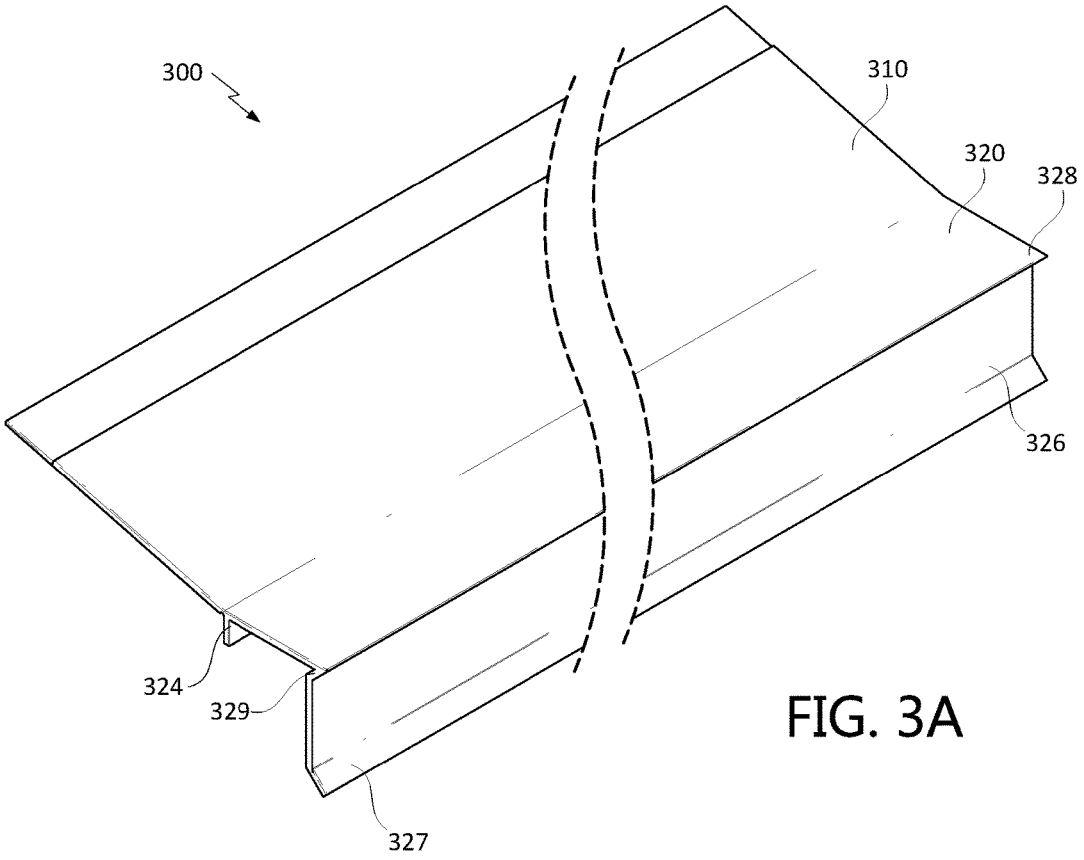
FIG. 3A is an isometric perspective view of a roof drip edge in accordance with a second example embodiment.
Figure 3B:
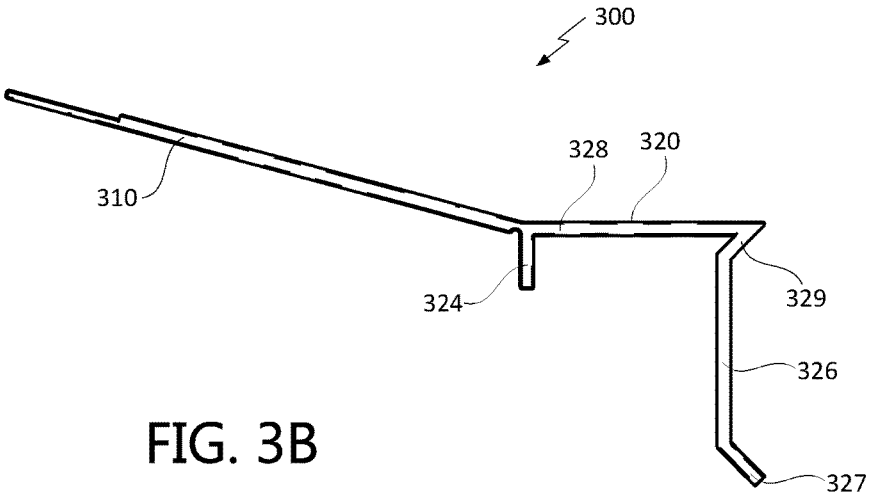
FIG. 3B is a side profile view of the roof drip edge of FIG. 3A.

FIGS. 3A and 3B depict an alternate configuration of a drip edge 300 in which the bridging member 328 extends laterally beyond the outer footing 326. Accordingly, the outer end of the bridging member 328 is connected to the vertical portion of the outer footing 326 by a second angled section 329. In addition, the angled section 327 at the distal end of the outer footing 326 terminates in a flat profile, rather than the filleted profile depicted and described with references to FIGS. 1A-2D. In some embodiments, the drip edge 300 depicted in FIGS. 3A and 3B may be implemented with a filleted end profile.

Figure 4A:
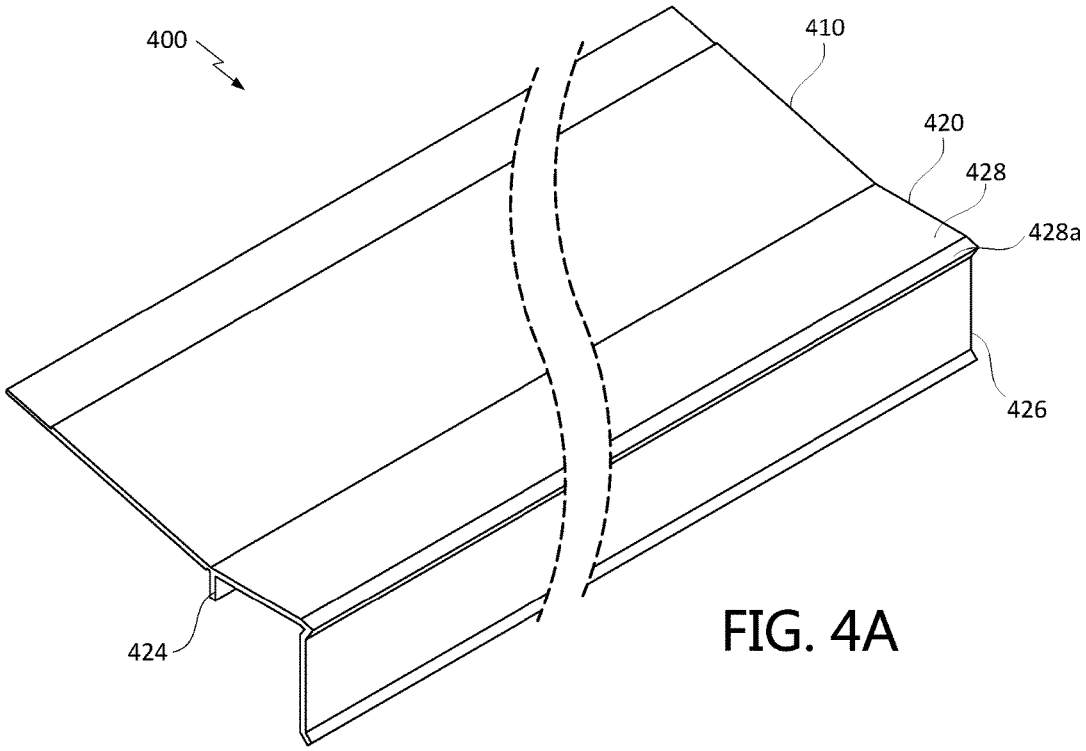
FIG. 4A is an isometric perspective view of a roof drip edge in accordance with a third example embodiment.
Figure 4B:
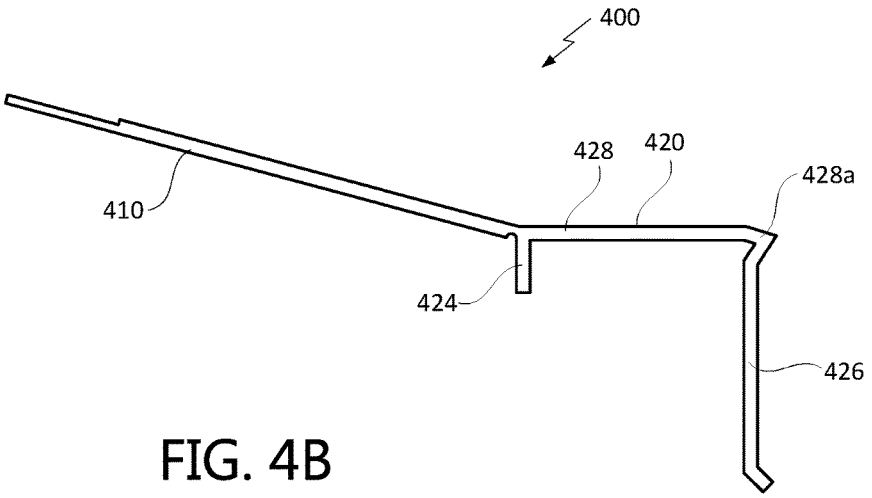
FIG. 4B is a side profile view of the roof drip edge of FIG. 4A.

FIGS. 4A and 4B depict an alternative configuration of a drip edge 400 similar to the drip edge 300. In the configuration of FIGS. 4A and 4B, a distal section 428*a* of the bridging member 428 extends at a relatively shallow downward angle, such as between 5 degrees and 20 degrees. The downward slope of the distal section 428*a* of the bridging member 428 may further aid in facilitating drainage of water, as gravity may tend to pull water along the distal portion 428*a* away from the building. In some embodiments, the drip edge 400 may be implemented with a filleted end profile. In some embodiments, the filleted profile can be formed by folding over the lower edge of the drip edge 400 in a manner such that the fold has a rounded profile.

Figure 5A:
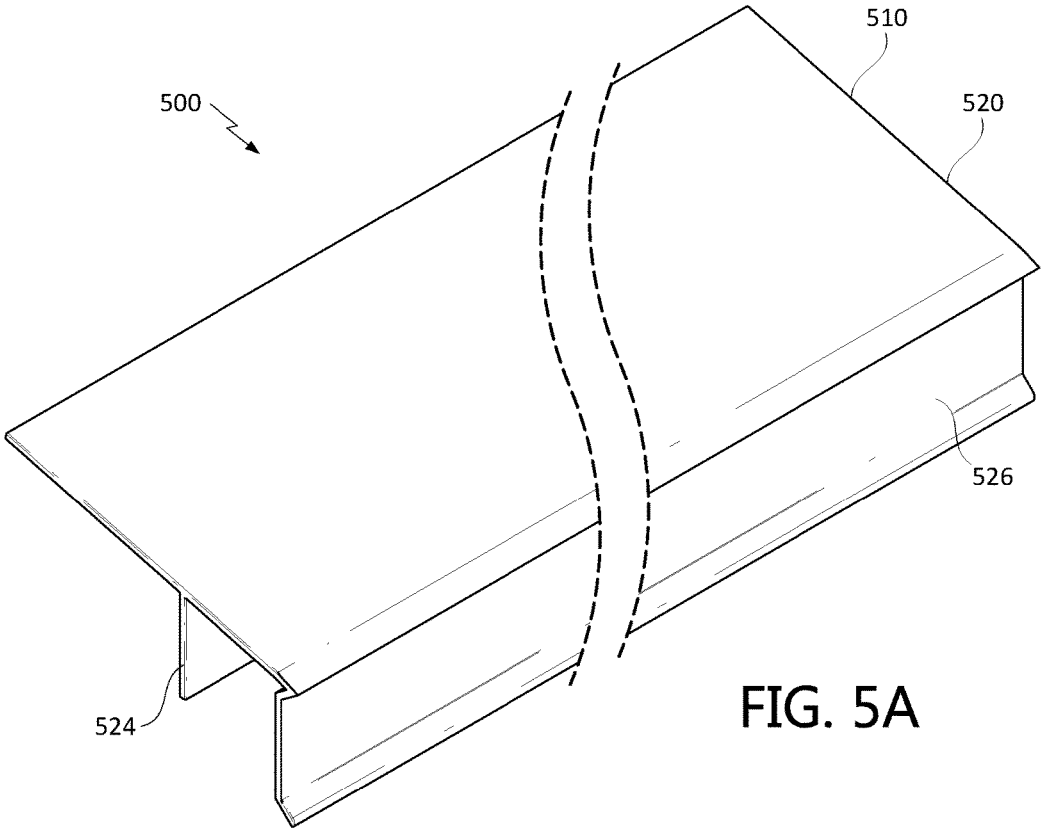
FIG. 5A is an isometric perspective view of a roof drip edge in accordance with a fourth example embodiment.
Figure 5B:
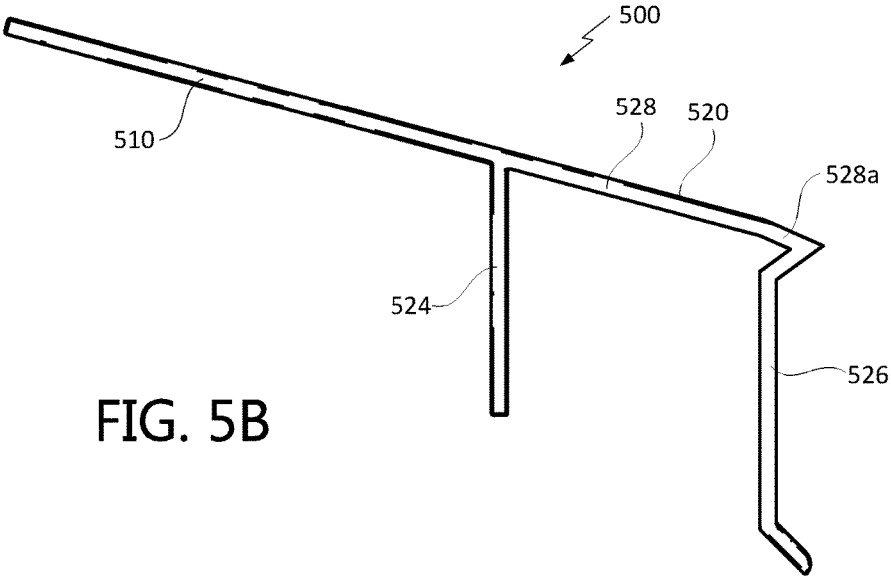
FIG. 5B is a side profile view of the roof drip edge of FIG. 5A.

FIGS. 5A and 5B depict an alternative configuration of a drip edge 500 similar to the drip edge 400, with a downward sloping distal section 528*a* of a bridging member 528. In the configuration of FIGS. 5A and 5B, the tail 510 and bridging member 528 are substantially parallel, collinear, and/or coplanar. The drip edge 500 does not include a divot or other bendable feature. Thus, when manufacturing the drip edge 500, the angle between the inner and outer footings 524, 526 and the bridging member 528 may be selected to be compatible with a desired range of roof pitches. In addition, the tail 510 of the drip edge 500 has a substantially uniform thickness, and is depicted without a locally thinner section for accommodating mechanical fasteners passing through the tail 510. A tail 510 of uniform thickness may be used with chemical fastening means, and/or may be manufactured with apertures for receiving mechanical fasteners. It will be appreciated that the configuration of drip edge 500 may readily be implemented with a locally thin and nailable portion of the tail 510.

Figure 6A:
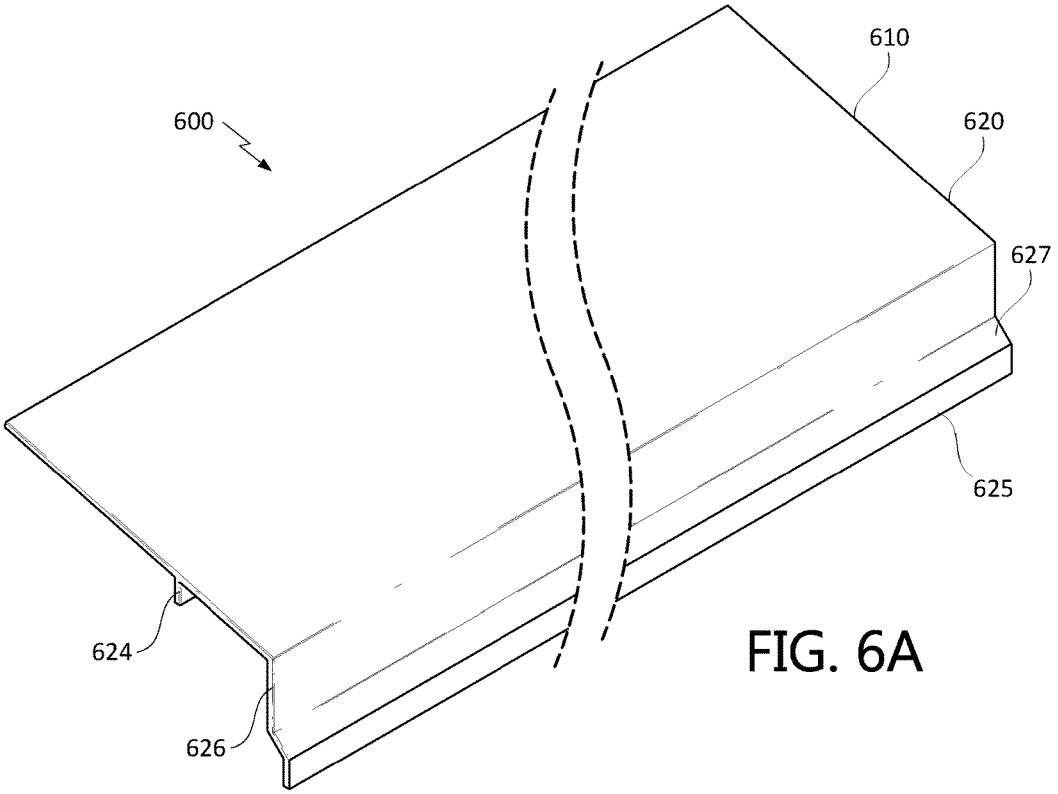
FIG. 6A is an isometric perspective view of a roof drip edge in accordance with a fifth example embodiment.
Figure 6B:
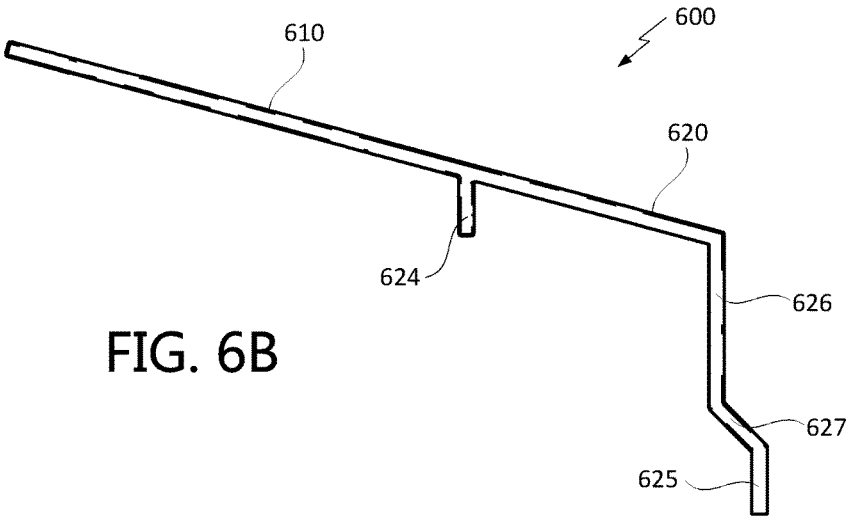
FIG. 6B is a side profile view of the roof drip edge of FIG. 6A.

FIGS. 6A and 6B depict an alternative configuration of a drip edge 600 in which the outer footing 626 comprises an angled section 627 near the distal end of the outer footing 626, as well as a second vertical section 625 disposed distal to the angled section 627. In some aspects, the second vertical section 625 below the angled section 627 may function similarly to the filleted profiles described elsewhere herein to facilitate the coalescence of water traveling to the end of the angled section 627. Although the drip edge 600 depicted in FIGS. 6A and 6B does not include a divot, some embodiments of the drip edge 600 may equally include a divot or other bending feature so as to accommodate a larger range of roof pitches. Similarly, the outer footing 626 profile of FIGS. 6A and 6B may be implemented with the locally thin upper tail sections 114, 214 depicted in FIGS. 1A-2D.

Figure 7A:
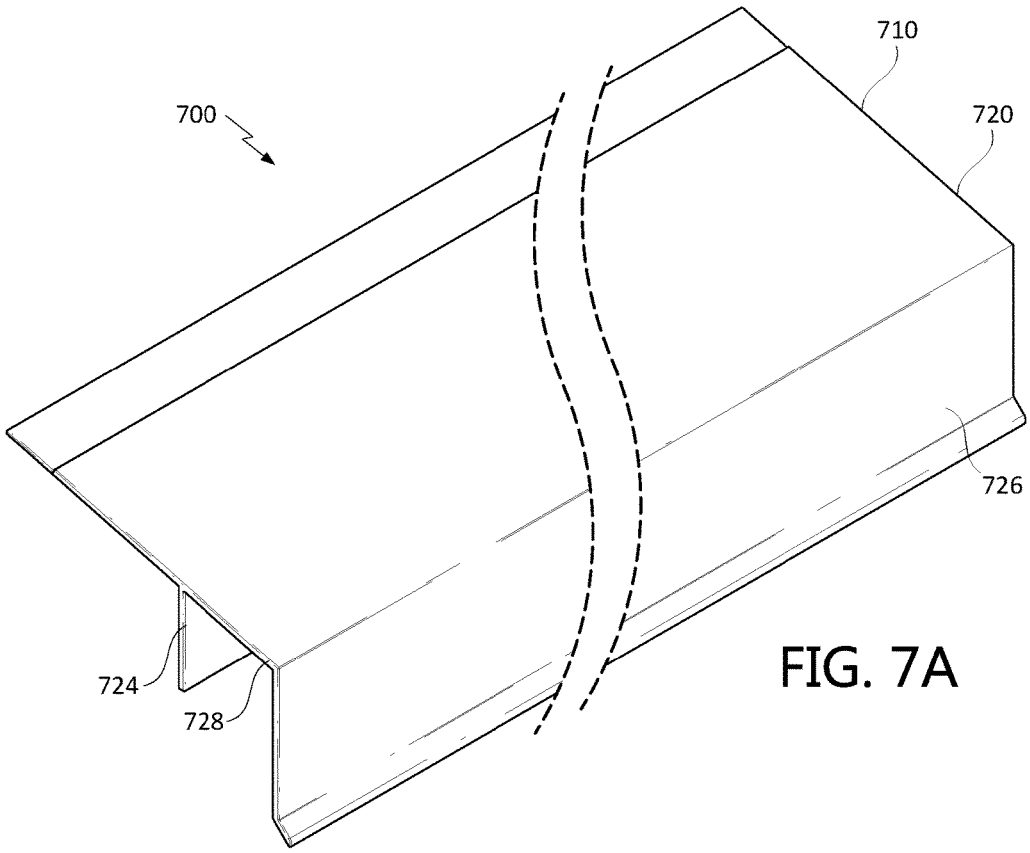
FIG. 7A is an isometric perspective view of a roof drip edge in accordance with a sixth example embodiment.
Figure 7B:
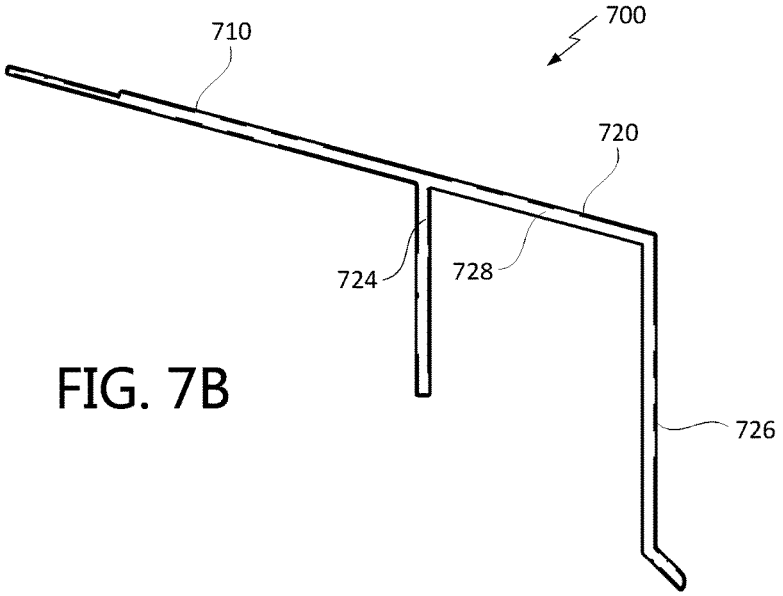
FIG. 7B is a side profile view of the roof drip edge of FIG. 7A.

FIGS. 7A and 7B depict an alternative configuration of a drip edge 700 generally similar to the drip edges 100, 200 depicted in FIGS. 1A-2D, without a divot or similar bending feature. As described with reference to FIGS. 5A and 5B, the angle between the tail 710 and the bridging member 728 can be predetermined based on the pitch of a particular roof and/or selected to be compatible with a particular range of roof pitches.

Figure 8A:
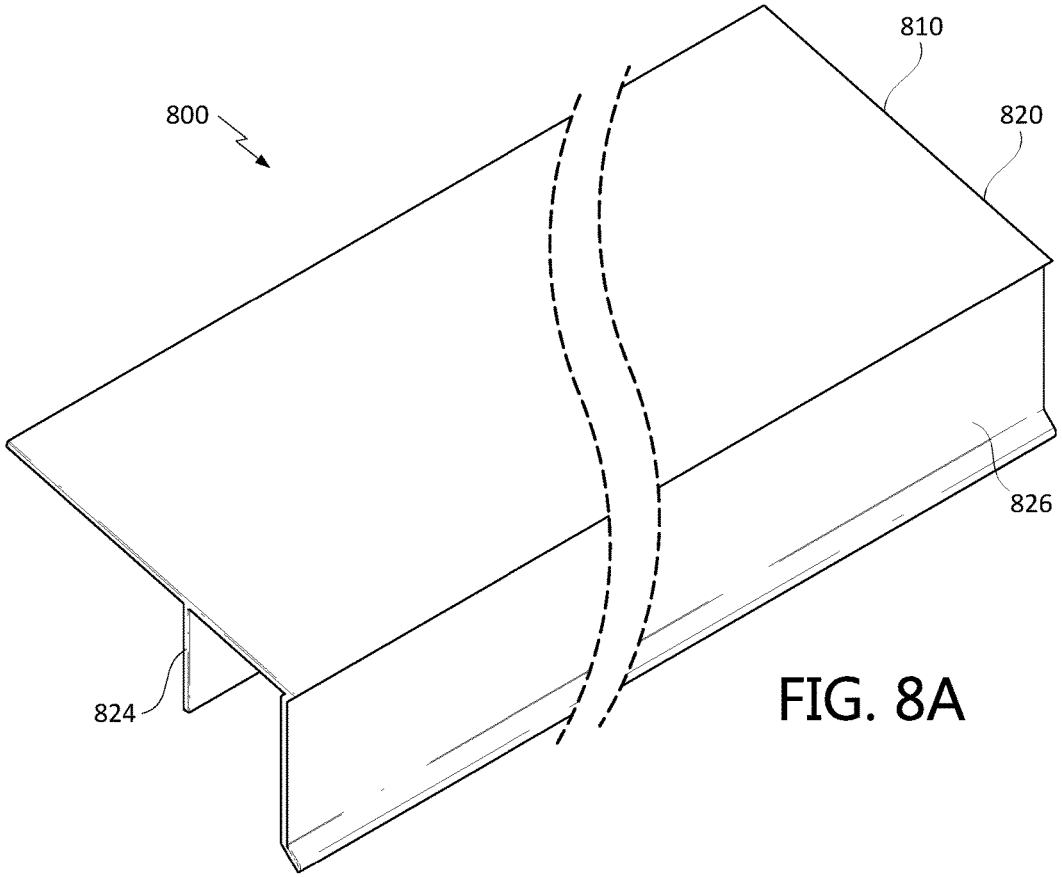
FIG. 8A is an isometric perspective view of a roof drip edge in accordance with a seventh example embodiment.
Figure 8B:
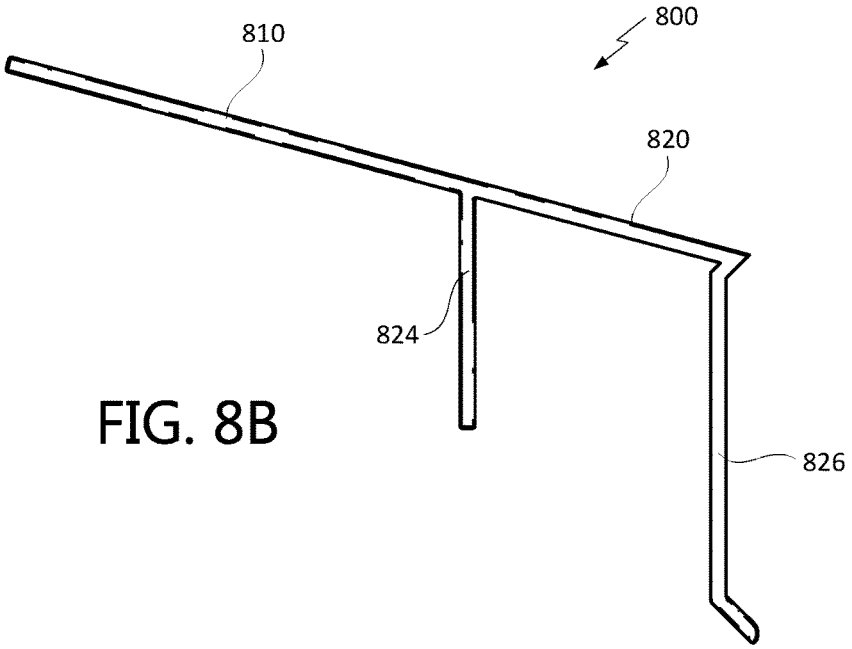
FIG. 8B is a side profile view of the roof drip edge of FIG. 8A.

FIGS. 8A and 8B depict an alternative configuration of a drip edge 800 having an outer footing 826 with a profile generally similar to the outer footing 326 of the drip edge 300 depicted in FIGS. 3A and 3B. Unlike the drip edge 300 of FIGS. 3A and 3B, drip edge 800 does not include a divot and has a tail 810 of substantially uniform thickness, similar to the tails 510, 610 depicted in FIGS. 5A-6B.

Figure 9:
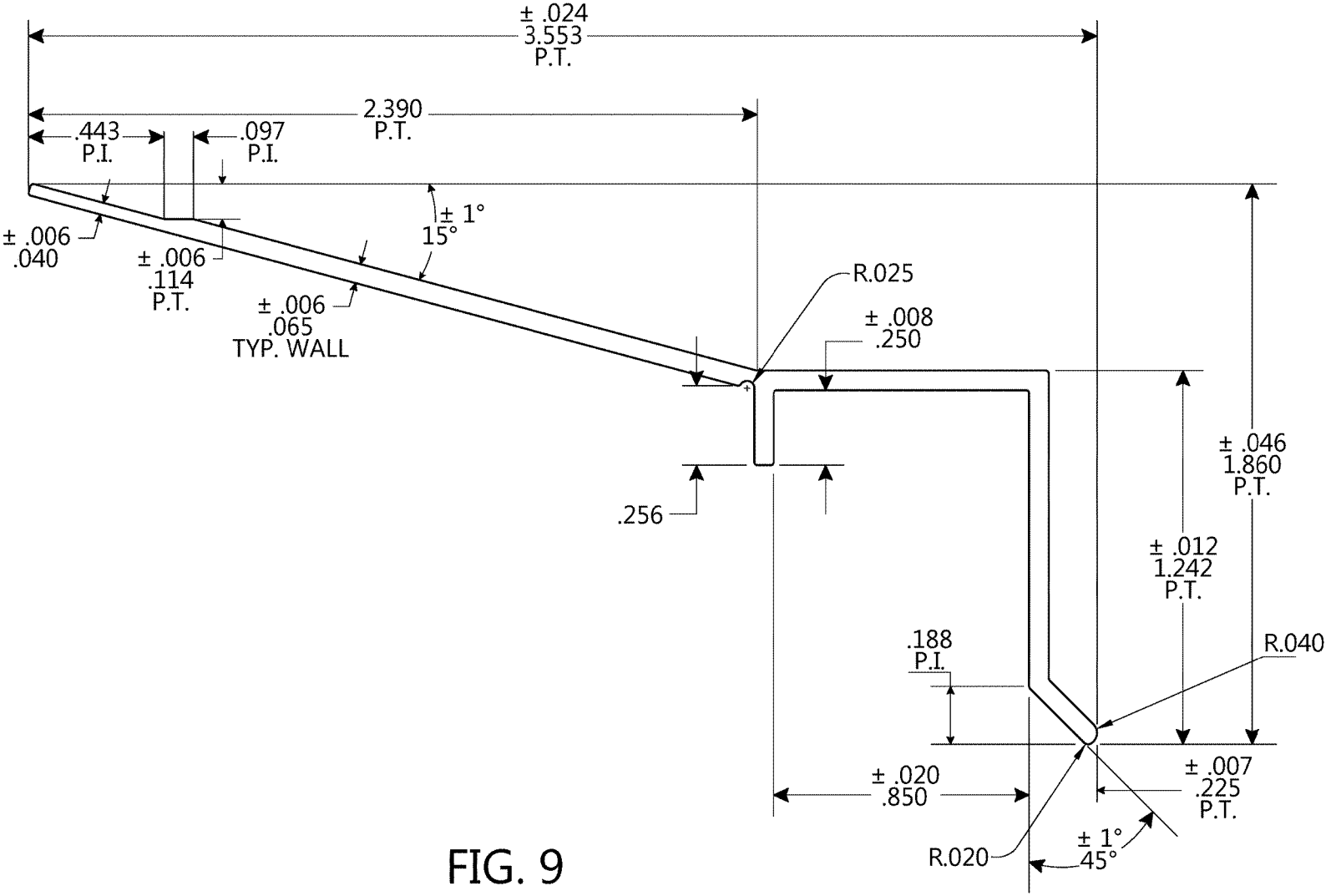
FIG. 9 is a side profile view of a roof drip edge in accordance with a further example embodiment.

FIG. 9 is a side profile view showing example dimensions of one embodiment of a drip edge having a side profile similar to the side profile of drip edge 100 depicted in FIGS. 1A-1D. In the embodiment shown in FIG. 9, the drip edge has a full width of 3.553 inches (90.2462 mm). The tail has a width of 2.390 inches (60.706 mm), of which the innermost 0.443 inches (11.2522 mm) comprise a narrowed upper end. The upper end has a thickness of 0.040 inches (1.016 mm), 38.5% thinner than the lower portion of the tail, which has a thickness of 0.065 inches (1.651 mm). The end of the outer footing has a filleted profile, with an upper radius of curvature of 0.040 inches (1.016 mm) and a lower radius of curvature of 0.020 inches (0.508 mm). The outer footing extends downward 1.242 inches (31.5468 mm) vertically from the bridging member. Other dimensions, angles, curvatures, and/or relationships between the various dimensions, angles, and/or curvatures of this embodiment will readily be understood as marked within FIG. 9.

Thus, as demonstrated by the various configurations illustrated in FIGS. 3A-8B, particular embodiments of the drip edge systems disclosed herein may include any combination of the advantages of individual features and/or combinations of features depicted and described without departing from the spirit or scope of the present disclosure.

FIGS. 10A-10D depict a further example configuration of a drip edge 1000 or section thereof in accordance with an example embodiment. The drip edge 1000 includes a tail 1010, an outer section 1020, and an inner footing 1024. The tail 1010 includes a lower layer 1011 and an upper layer 1013 adjacent to the lower layer 1011. The lower layer 1011 and the upper layer 1013 are contiguous (e.g., integrally formed or formed from a single piece of sheet metal) at a longitudinal tail joint 1015. The outer section 1020 includes an outer footing 1026 and a bridging member 1028 disposed between the outer footing 1026 and the tail 1010. The upper layer 1013 of the tail 1010 is contiguous (e.g., integrally formed or formed from a single piece of sheet metal) with the bridging member 1028 of the outer section 1020 at an upper angled joint 1030. The lower layer 1011 of the tail 1010 is contiguous (e.g., integrally formed or formed from a single piece of sheet metal) with the inner footing 1024 at a lower angled joint 1025. The drip edge 1000 thus includes a downward-facing c-shaped channel 1022 defined generally by the inner footing 1024, the outer footing 1026, and the bridging member 1028.

The drip edge 1000 can comprise a metal, for example, aluminum, steel, or other suitable metal. The drip edge 1000 can be formed in the profile depicted in FIG. 10D by any suitable metal working method, for example, extruding, rolling, bending, molding, or the like. In some embodiments, the drip edge 1000 is made of rolled and/or bent aluminum. The drip edge 1000 may be formed from a relatively thin metal as compared to the thickness of conventional drip edge flashing. For example, in some implementations, the drip edge 1000 has a uniform thickness of approximately 0.022" (0.5588 mm). In some embodiments, the drip edge 1000 comprises 23 gauge sheet aluminum. In other embodiments, the thickness of the drip edge 1000 can be any suitable range, such as between 0.0159" and 0.0285" (between 0.40386 mm and 0.7239 mm, or between 26 gauge and 21 gauge sheet aluminum), between 0.015" and 0.03" (between 0.381 mm and 0.762 mm), or the like.

The drip edge 1000 can be made in various sizes. For example, the width a of the tail 1010 (e.g., the distance between the angled joint 1030 and the tail joint 1015) can be any suitable distance such as 2 inches (5.08 cm), 3 inches (7.62 cm), or longer. In certain embodiments, the width of the tail 1010 is between 2 inches (5.08 cm) and 3 inches (7.62 cm). In another example, the length b of the drip edge 1000 (e.g., the length of the drip edge 1000 along the angled joint 1030) can be less than 1 foot (less than 0.3048 m), 1 foot (0.3048 m), 2 feet (0.6096 m), 5 feet (1.524 m), 10 feet (3.048 m), or longer. In some embodiments, the drip edge 1000 can be manufactured in a first length b which can be cut down to a shorter custom length by a drip edge installer based on the length of a section of roof edge to be covered. It will be appreciated that the various functions and advantages of the drip edges described herein can be achieved with relatively short and/or long drip edge sections. Where a relatively long roof edge is to be covered, a plurality of sections of drip edge 1000 can be combined to achieve a longer drip edge system. For example, in some embodiments a plurality of sections of drip edge 1000 can be placed end-to-end. In some embodiments, two adjacent sections of drip edge 1000 may be at least partially overlapped along their lengths b to prevent the intrusion of water at the joint therebetween. For example, in some implementations one or more of the inner footing 1024, outer footing 1026, or bridging member 1028 may be removed from the drip edge along a terminal overlapping portion (e.g., a portion of the length b) of one of the two adjacent drip edges 1000 to facilitate overlapping of the adjacent drip edges. In one example, the inner footing 1024 is removed along the terminal overlapping portion of a first drip edge 1000 such that the terminal overlapping portion can be installed over and rest above a portion of a second adjacent drip edge 1000. The relative locations of the two drip edges 1000 may be selected such that the remaining section of the inner footing 1024 of the first drip edge 1000 abuts and does not overlap the inner footing 1024 of the second drip edge 1000. In another example, the inner footing 1024, outer footing 1026, and bridging member 1028 are removed along the terminal overlapping portion of a first drip edge 1000 such that only the tail 1010 overlaps or rests under the tail of a second adjacent drip edge 1000. The relative locations of the two drip edges 1000 may be selected such that the remaining sections of the inner footing 1024, outer footing 1026, and bridging member 1028 of the first drip edge 1000 abut and do not overlap the inner footing 1024, outer footing 1026, and bridging member 1028 of the second drip edge 1000. In some embodiments, two adjacent drip edges 1000 may meet at a corner of a building substrate. At a corner, the two adjacent drip edges 1000 may at least partially overlap using any of the overlapping methods described above. In some embodiments, two drip edges 1000 meeting at a corner may be cut at an angle (e.g., 45 degrees relative to the length b of each drip edge 1000) to meet end-to-end at a miter joint. It will be understood that the end-to-end, overlapping, and corner coverage methods described above may be implemented with any of the drip edges described herein.

The lower layer 1011 and the upper layer 1013 of the tail 1010 form a double-layer tail. In some embodiments, the lower layer 1011 and the upper layer 1013 have substantially the same size and shape (e.g., they overlap completely or are substantially coextensive). Accordingly, the tail 1010 may comprise a uniform double layer. The double-layer configuration of the tail 1010 may provide enhanced structural strength. The drip edge 1000 may be secured to a substrate by nails or other mechanical fasteners by passing the fasteners through the upper layer 1013 and the lower layer 1011, and into the substrate. The tail 1010 thus has an effective thickness twice as thick as the thickness of the inner and outer footings 1024, 1026 and the bridging member 1028. The double thickness of the tail may advantageously reduce the probably of deforming or uncoupling the tail 1010 from the substrate at the locations of the fasteners. Moreover, forming the tail 1010 as two coextensive layers may provide the tail with a larger effective thickness while allowing each layer 1011, 1013 of the tail 1010 to be bent relatively easily relative to the other components of the drip edge 1000.

The inner footing 1024 of the drip edge 1010 extends downward from the lower angled joint 1025 and may serve as a guide to define an installation position for the drip edge 1010 when the inner footing 1024 is placed adjacent to an outward-facing portion of a building substrate. The size of the inner footing 1024 is defined by a length e between the lower angled joint 1025 and an opposing end of the inner footing 1024. The length e of the inner footing 1024 may be, for example, 1" (25.4 mm), 1.5" (38.1 mm), 2" (50.8 mm), or greater. In some implementations, a length e shorter than 1" (25.4 mm) may prevent the inner footing 1024 from reliably resting against the eave or other underlying substrate, for example, where a sheathing is present above the eave, while a length e of 1" (25.4 mm) or greater may ensure that the inner footing 1024 rests against the eave and not merely against an overlying sheathing, which may not be coextensive with the eave. Additionally, the length e may be selected to be short enough such that the inner footing 1024 does not extend farther downward than the outer footing 1026.

The outer section 1020 of the drip edge 1010 is configured to extend and carry draining water away from an edge of a roof surface. The size of the outer footing 1026 is defined by a length f between the bridging member 1028 and an angled section 1027. The length f may preferably be longer than the length e of the inner footing so as to guide draining water to a height substantially lower than the top edge of a fascia board installed within the c-shaped channel 1022. In various embodiments, the length of the outer footing 1026 can be any suitable length such as between 1" and 6" (between 25.4 mm and 152.4 mm), between 1" and 5" (between 25.4 mm and 127 mm), or the like. For example, the outer footing 1026 of the drip edge 1000 has a length f of approximately 1.5" (38.1 mm).

At least a portion of the outer footing 1026 can be an angled section 1027 or lip configured to further guide water away from the roof edge. The angled section 1027 is located at a distal end of the outer footing 1026 and extends along a length g at an angle relative to the vertically oriented proximal portion of the outer footing 1026. In various embodiments the angle can be between 0 and 60 degrees so as to direct water away from the side of a building while continuing to facilitate the downward flow of water along the outer footing 1026. For example, the angled portion 1027 of the drip edge 1000 depicted is angled at approximately 30 degrees relative to the remainder of the outer footing 1026. The length g may be any suitable length such as between 0.1875" and 1" (between 4.7625 mm and 25.4 mm), between 0.1875" and 0.5" (between 4.7625 mm and 12.7 mm), or the like. For example, the angled section 1027 of the drip edge 1000 may have a length g of approximately 0.25" (6.35 mm).

In some embodiments, the end of the angled section 1027 of the outer footing 1026 is further shaped so as to facilitate the coalescence of water at the end of the drip edge 100. As shown in FIG. 10D, the angled section 1027 is doubled (e.g., bent or rolled to form a double layer along the angled section 1027) at a longitudinal angled section joint 1021. In some embodiments, the angled section joint 1021 may have a curved exterior profile that facilitates coalescence of water to promote efficient drainage.

In some embodiments, the outer footing 1026 and/or the angled section 1027 may further serve as an attachment point for a surface water collection channel (e.g., guttering, rain gutter, eaves gutter, etc.) and/or may comprise at least a portion of the surface water collection channel. For example, one or more sections of guttering may be coupled longitudinally to the bottom of the angled section 1027 parallel to the length b of the drip edge 1000 so as to collect liquid traveling downward along the outer footing 1026. In another example, a lower portion of the outer footing 1026 may extend outward (e.g., in a direction opposite the c-shaped channel 1022) in an upwardly concave profile to function as a surface water collection channel.

The inner footing 1024, outer footing 1026, and bridging member 1028 define the c-shaped channel 1022. The width d of the c-shaped channel 1022 is defined by the length of the bridging member 1028. In various embodiments, the width d of the c-shaped channel 1022 can be any width in the range of approximately 0.5" (12.7 mm), 0.75" (19.05 mm), 1" (25.4 mm), 1.25" (31.75 mm), 1.5" (38.1 mm), or greater. In one non-limiting example, the drip edge 1000 may have a width d of the c-shaped channel 1022 of approximately 1.0625" or 17/16" (26.9875 mm). Preferably, the width d of the c-shaped channel 1022 is at least slightly larger than the thickness of a fascia board to be installed. For example, in one embodiment the 1.0625" c-shaped channel 1022 may be conveniently sized to accommodate a fascia board having a nominal thickness of 1.25 inch (e.g., dimensional lumber of nominal size 1.25×2, 1.25×4, 1.25×6, or the like, having an actual thickness of approximately 1" or 38.1 mm), with a tolerance of approximately 0.0625" (1.5875 mm). In another example, a c-shaped channel 1022 configured to fit a nominal 1 inch fascia board may have a width d of approximately 0.8125" (20.6375 mm).

Figure 10A:
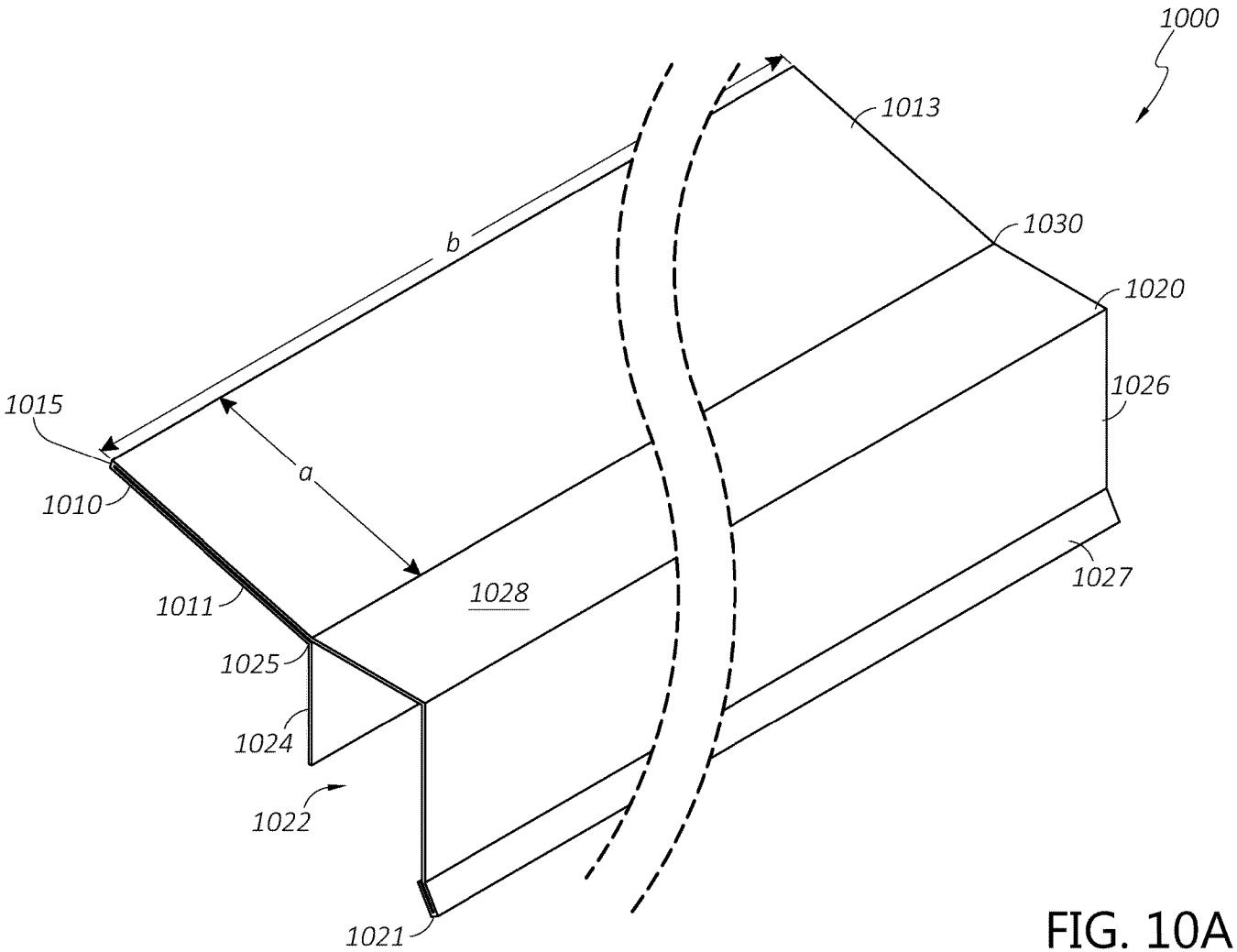
FIG. 10A is an isometric perspective view of a roof drip edge in accordance with an eighth example embodiment.
Figure 10B:
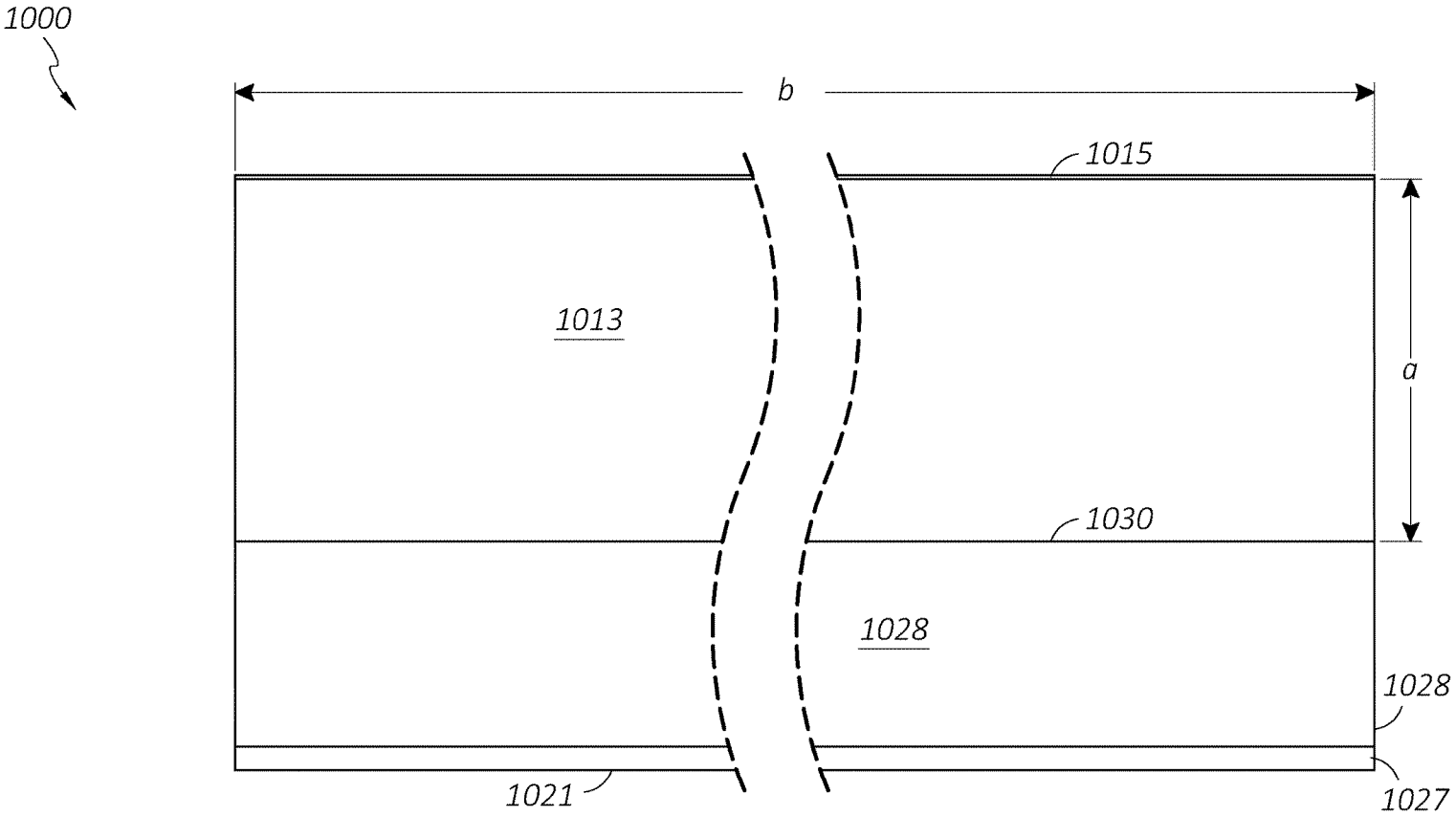
FIG. 10B is a top view of the roof drip edge of FIG. 10A.
Figure 10C:
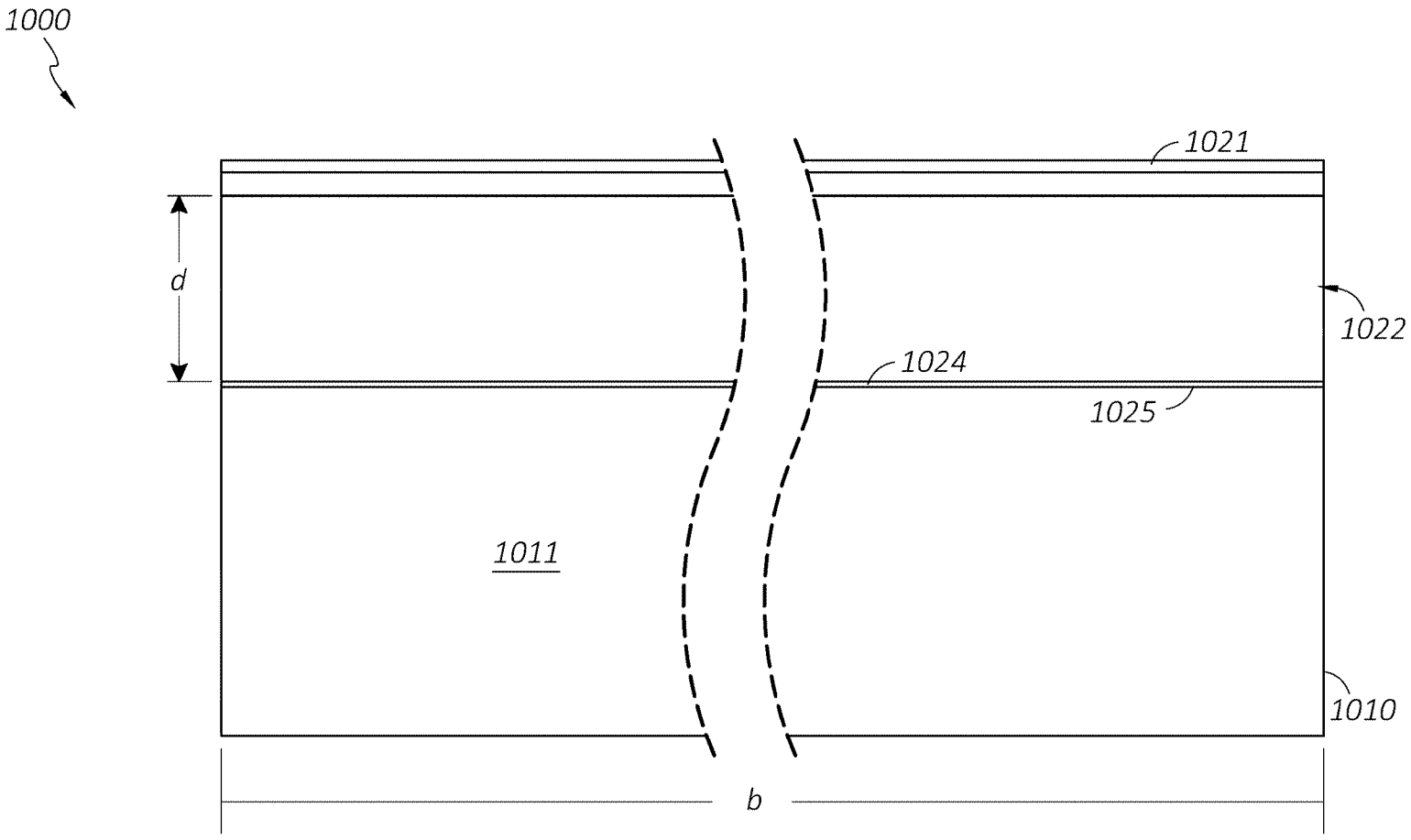
FIG. 10C is a bottom view of the roof drip edge of FIGS. 10A and 10B.
Figure 10E:
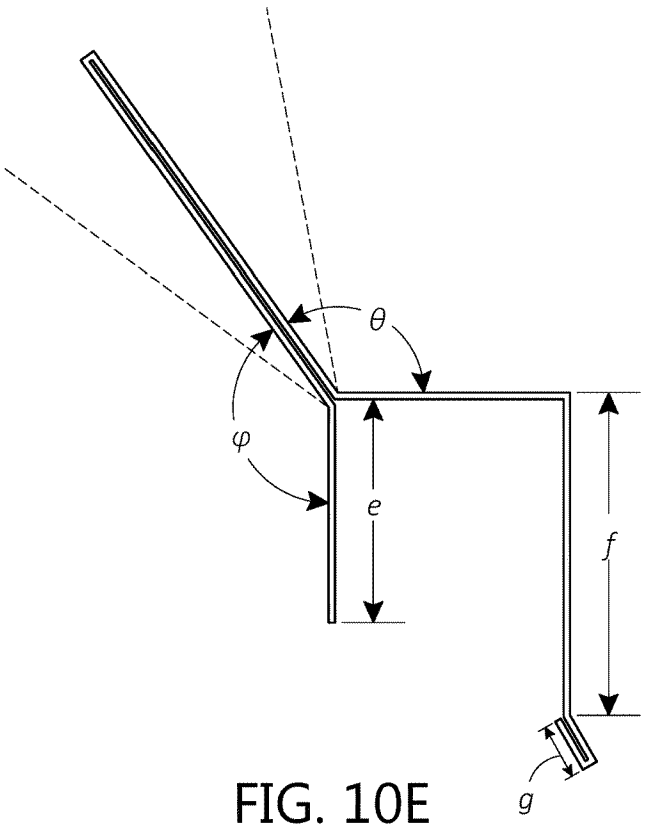
FIGS. 10D and 10E are side profile views of the roof drip edge of FIGS. 10A-10C.
Figure 10D:
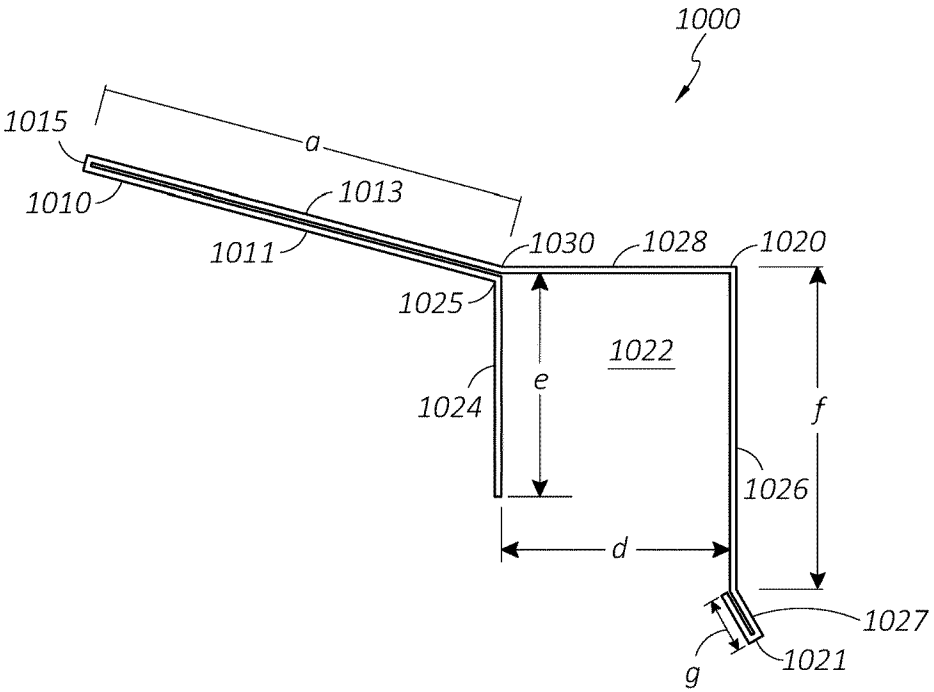
Figure 16A:
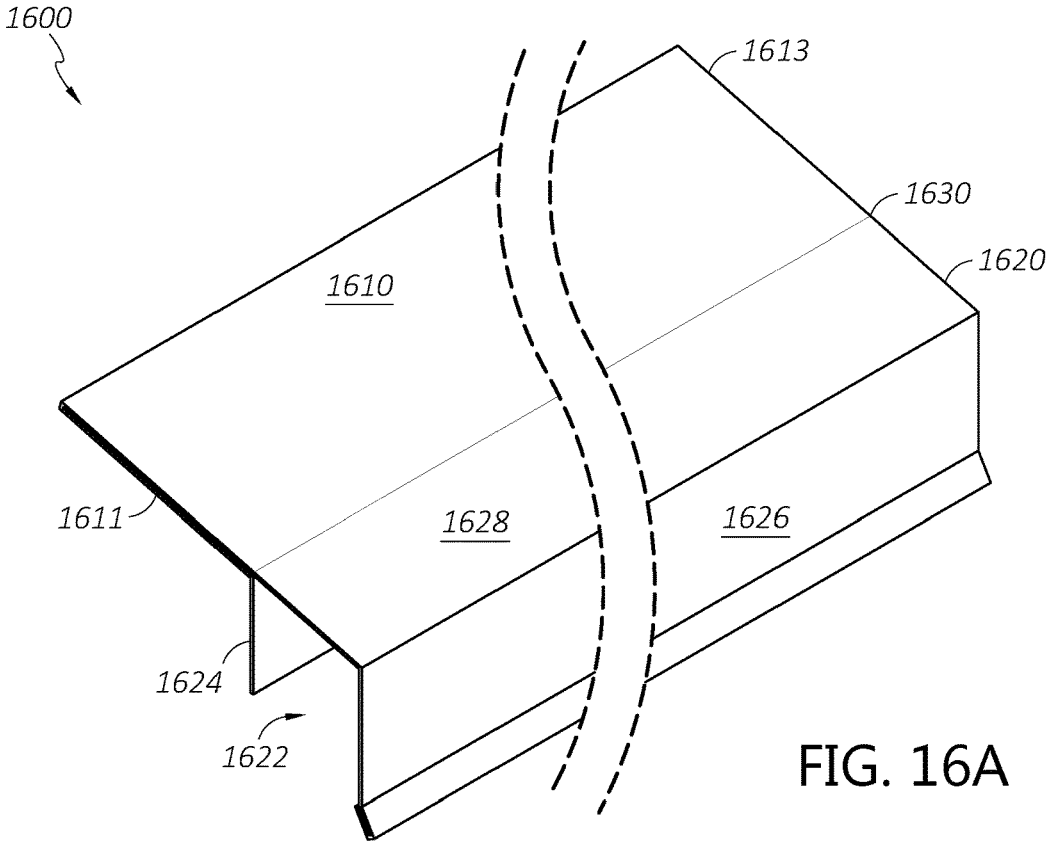
FIG. 16A is an isometric perspective view of a roof drip edge in accordance with a thirteenth example embodiment.
Figure 16B:
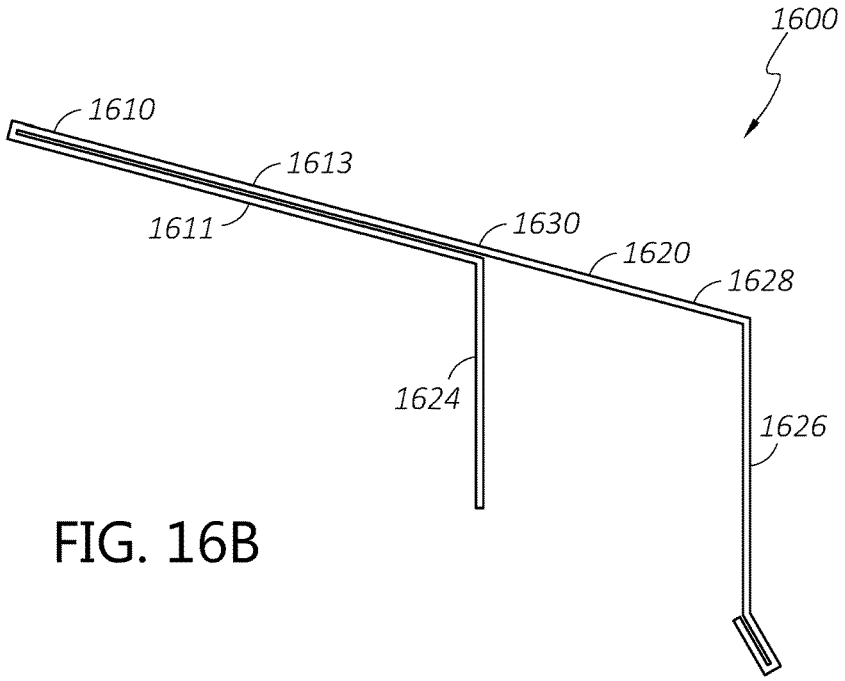
FIG. 16B is a side profile view of the roof drip edge of FIG. 16A.

Referring now to FIG. 10E, the drip edge 1000 may be configured and/or modified to fit any desired roof angle (e.g., the roof angle defined by an existing roof substrate) based on an angle of the tail 1010 with respect to the outer section 1020 and/or the inner footing 1024. In the double-layer tail configuration of the drip edge 1000, the upper angled joint 1030 and the lower angled joint 1025 may each be independently selectable and/or adjustable with respect to the remainder of the drip edge 1000. The upper angled joint 1030 is defined by an angle θ between the upper layer 1013 of the tail 1010 and the bridging member 1028. Similarly, the lower angled joint 1025 is defined by an angle φ between the lower layer 1011 of the tail 1010 and the inner footing 1024. In embodiments in which the bridging member 1028 is approximately flat or parallel to the ground, the sum of the angles θ and φ may be approximately 270 degrees, although the sum of θ and φ may be greater than 270 degrees where the bridging member 1028 is downward sloping (e.g., as shown in FIGS. 16A and 16B). In various embodiments, the angle θ may be greater than 90 degrees and less than or equal to 180 degrees, such as any angle between 135 degrees and 180 degrees.

Referring now to FIGS. 11A-11D, a drip edge 1100 is depicted as installed to a building substrate 1150. The drip edge 1100 installed in FIGS. 11A-11D can be any of the drip edges 1000, 1200, 1300, 1400, 1500, 1600 depicted and described herein. The building substrate 1150 can be an eave or a portion thereof, or any other upper structural portion of a building. For example, the building substrate 1150 can include a rafter, a truss, or the like. In some embodiments, the substrate 1150 is covered with a sheathing 1155, such as oriented strand board, plywood, or the like. The substrate 1150 and/or optional sheathing 1155 can receive mechanical fasteners (e.g., nails or other fasteners) to secure the drip edge 1100 and a roofing material 1160 relative the substrate 1150 and/or sheathing 1155.

Figure 11A:
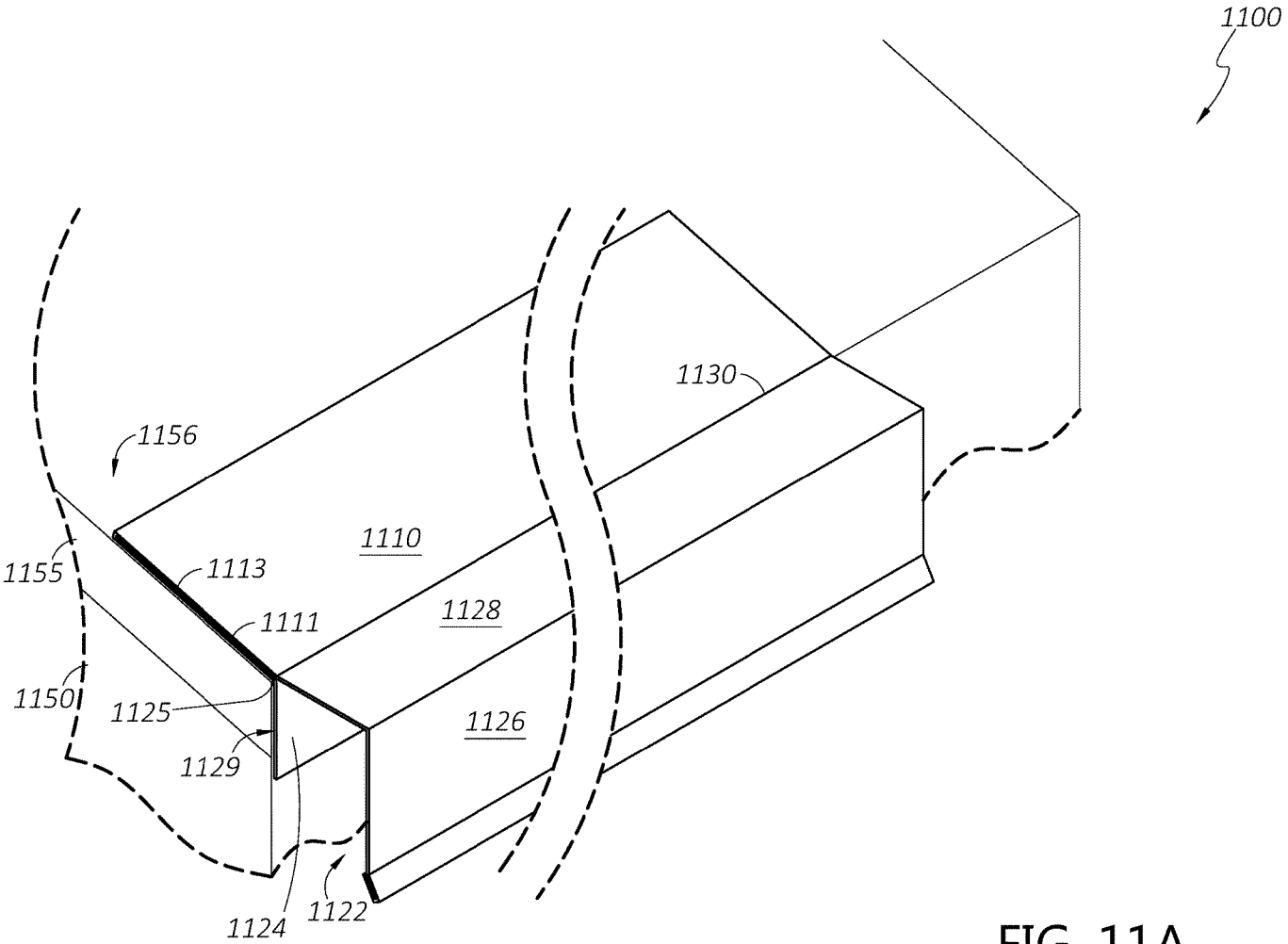
FIG. 11A is an isometric perspective view of an example configuration of the roof drip edge depicted in FIGS. 10A-10D installed on a roof sheathing.
Figure 11B:
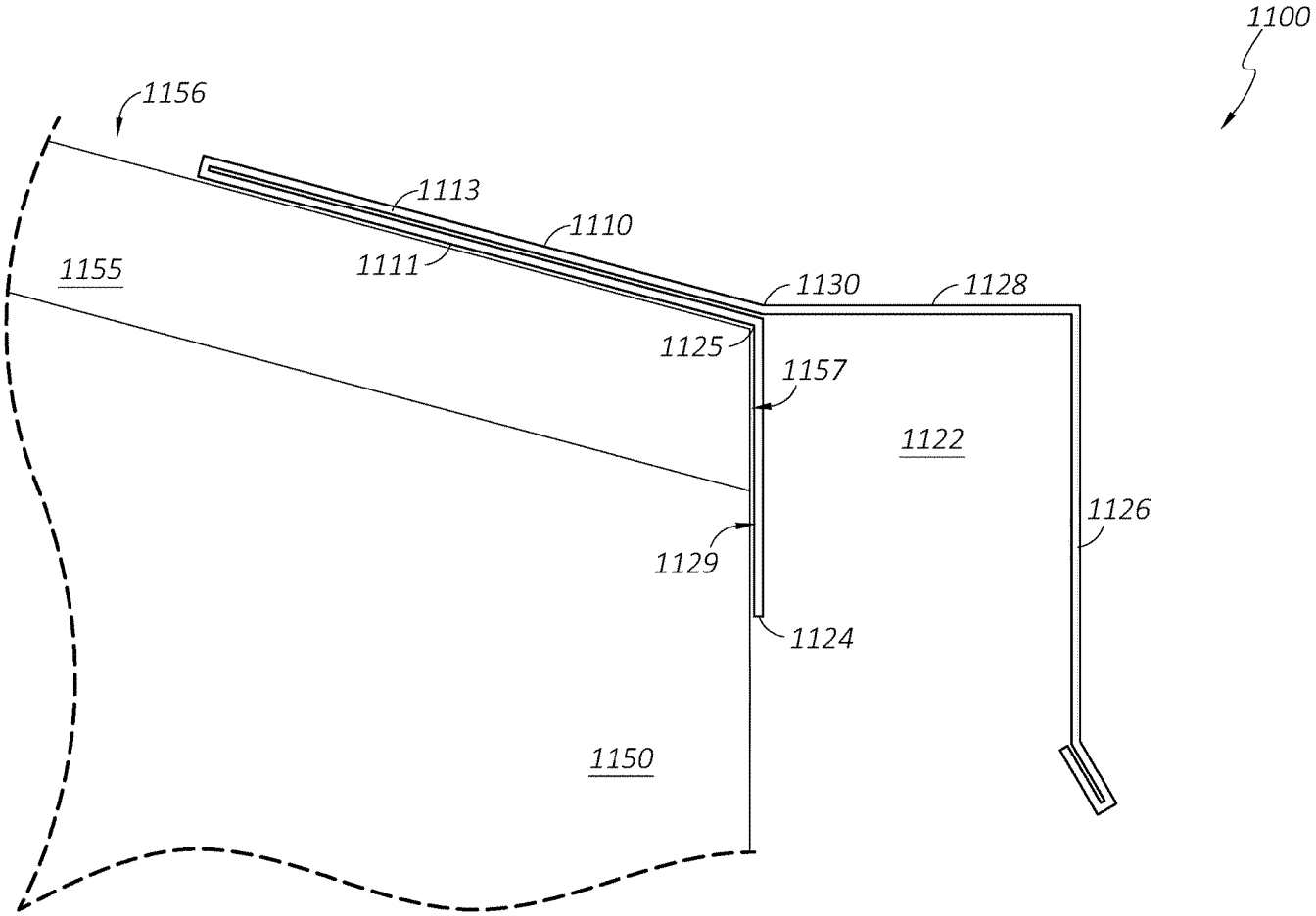
FIG. 11B is a side profile view of the installed configuration of FIG. 11A.

As shown in FIGS. 11A and 11B, the drip edge 1100 can be secured to the sheathing 1155 before a roofing material and fascia board (not shown in FIGS. 11A-11B) are installed. The drip edge 1100 is positioned for installation by positioning the tail 1110 against an upper surface 1156 of the sheathing 1155 or substrate 1150 and positioning a back surface 1129 of an inner footing 1124 against a side-facing surface 1157 of the sheathing 1155 or substrate 1150. When the drip edge 1100 has been placed against the substrate 1150 or sheathing 1155, it can be secured in place by the use of mechanical fasteners, such as nails, which may be driven downward into the substrate 1150 and/or sheathing 1155 through the upper layer 1113 and the lower layer 1111 of the tail 1110.

At any time before, during, or after installation of the drip edge 1100 to the building substrate 1150, the angle between the upper layer 1113 of the tail 1110 and the bridging member 1128 can be adjusted based on the pitch of the roof by bending the drip edge 1100 at the upper angled joint 1130. Similarly, the angle between the lower layer 1111 of the tail 1110 and the inner footing 1124 can be adjusted by bending the drip edge 1100 at the lower angled joint 1125. For example, the angles of the upper and lower angled joints 1130, 1125 can be adjusted such that, when the tail 1110 is lying parallel to the sheathing 1155, the bridging member 1128 is oriented in a substantially horizontal direction and the inner and outer footings 1124, 1126 are oriented in a substantially vertical direction. The drip edge 1100 may be bent at the lower angled joint 1125 and/or the upper angled joint 1130 to the appropriate angles before installation based on a measurement of the pitch of the roof, or may be bent after installation based on an observed deviation from the desired final orientation of the outer section 1120. In one non-limiting example, the lower angled joint 1125 may first be bent prior to securing the drip edge 1100 to the building substrate 1150, and the upper angled joint 1130 may be bent after the drip edge 1100 is secured. Such adjustability may be facilitated where the drip edge 1100 is formed from a bendably thin sheet metal, such as a sheet aluminum between 21 gauge and 26 gauge.

Figure 11C:
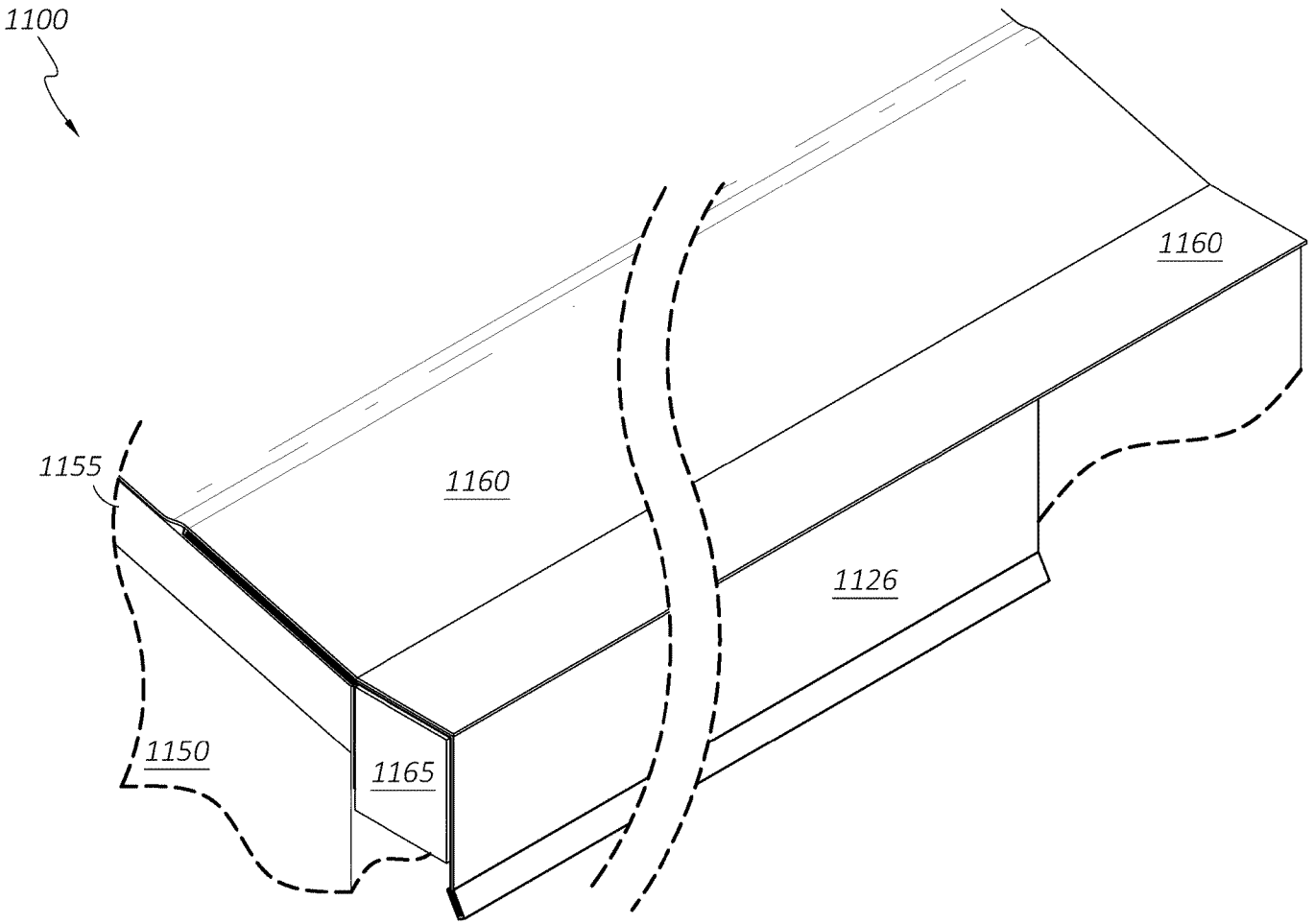
FIG. 11C is an isometric perspective view of the installed roof drip edge of FIGS. 11A and 11B after installation of roofing materials and a fascia.
Figure 11D:
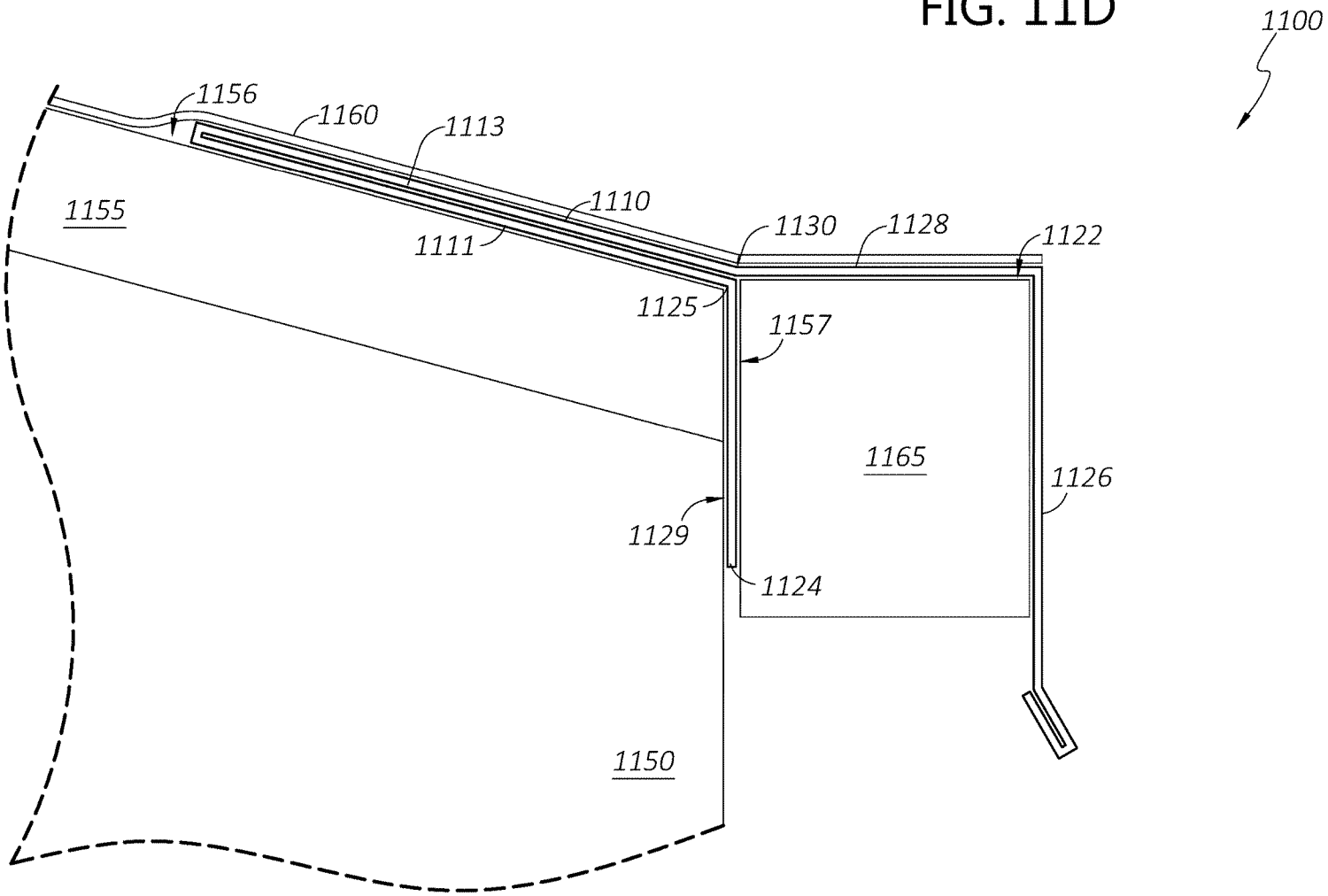
FIG. 11D is a side profile view of the installed configuration of FIG. 11C.

As shown in FIGS. 11C and 11D, a roofing material 1160 and a fascia board 1165 can then be installed by securing to the substrate 1150 and/or sheathing 1155. The roofing material 1160 can be any exterior roofing, for example, asphalt shingle, wood or other shingle, tile, membrane roofing, metal roofing, thatch, or the like. The roofing material 1160 can be secured to the upper surface 1156 by one or more mechanical fasteners such that the roofing material 1160 at least partially covers the tail 1110 and/or the bridging member 1128 of the drip edge 1100, thereby directing water from the roof to be drained away from the building efficiently by the drip edge 1100. In some embodiments, the roofing material 1160 may cover only the tail 1110 or a portion thereof, may cover the entirety of the tail 1110 and the bridging member 1128, or may extend beyond the outer end of bridging member 1128 (e.g., the roofing material 1160 may be fully sloped over the drip edge 1100 to facilitate drainage of water).

The fascia board 1165, which can be wood, metal, plastic, or the like, is placed within the c-shaped channel 1122 of the drip edge 1100. The thickness of the fascia board 1165 can be selected so as to fit within the c-shaped channel 1122 of the drip edge 1100. In some embodiments, the size and/or shape of the channel may be selected to accommodate a desired size and/or shape of fascia board 1165. In the example depicted in FIGS. 11C and 11D, the channel is a c-shaped channel 1122 sized to fit a rectangular fascia board having a desired width. In other embodiments, the channel may be sized to accommodate a thicker or thinner fascia board 1165, and/or may be shaped to accommodate a fascia board 1165 having a non-rectangular profile, such as a beveled profile (e.g., a trapezoidal cross-section), a rounded profile, or other profile having a non-uniform thickness (e.g., a notched or angled fascia board 1165). After the fascia board 1165 is placed within the c-shaped channel 1122, the fascia board 1165 is secured to the side-facing surface 1157 by one or more mechanical fasteners. In some aspects, the use of the inner footing 1124 as a guide for positioning the drip edge 1100 can thus allow a roofer to easily and efficiently install the drip edge 1100 with sufficient space for the fascia board 1165.

With reference to FIGS. 12A-16B, additional embodiments of the drip edges described herein will be described. Each embodiment of a drip edge 1200, 1300, 1400, 1500, 1600 depicted in FIGS. 12A-16B comprises a tail 1210, 1310, 1410, 1510, 1610, an inner footing 1224, 1324, 1424, 1524, 1624, and an outer section 1220, 1320, 1420, 1520, 1620 including a bridging member 1228, 1328, 1428, 1528, 1628, and an outer footing 1226, 1326, 1426, 1526, 1626. Thus, drip edges 1200, 1300, 1400, 1500, 1600 can be installed to a building substrate in substantially the same manner as drip edges 1000, 1100 described above.

Figure 12A:
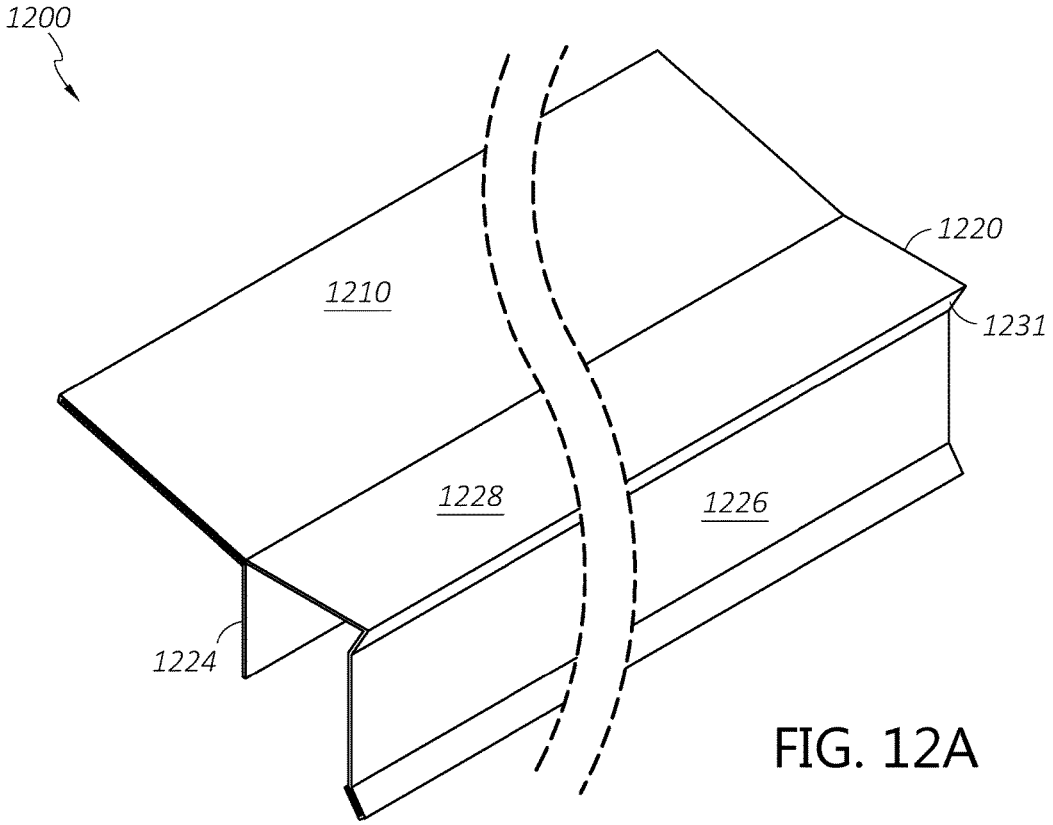
FIG. 12A is an isometric perspective view of a roof drip edge in accordance with a ninth example embodiment.
Figure 12B:
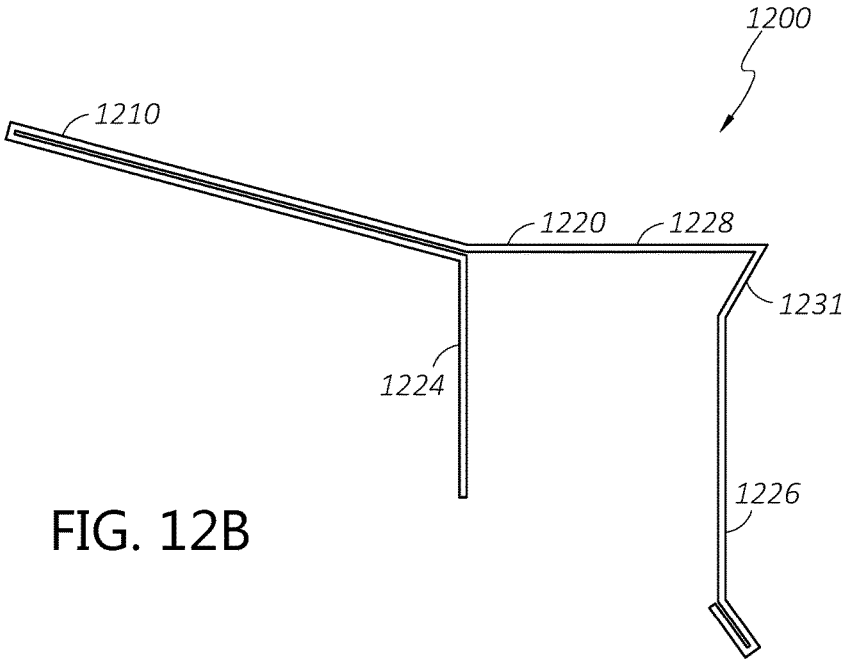
FIG. 12B is a side profile view of the roof drip edge of FIG. 12A.

FIGS. 12A and 12B depict an alternate configuration of a drip edge 1200 in which the bridging member 1228 extends laterally beyond the outer footing 1226. Accordingly, the outer end of the bridging member 1228 is connected to the vertical portion of the outer footing 1226 by a second angled section 1231. In some embodiments, the extension of the bridging member 1128 may be provided for aesthetic effect and/or to further facilitate the flow of water away from the building.

Figure 13A:
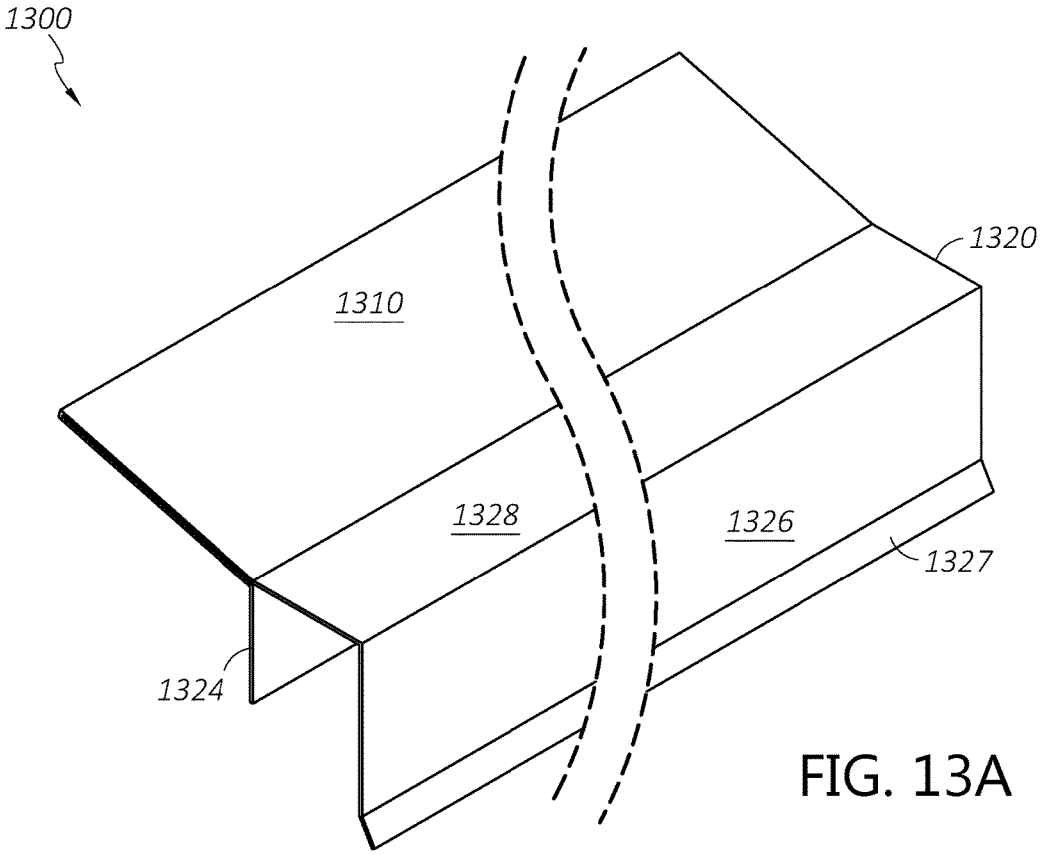
FIG. 13A is an isometric perspective view of a roof drip edge in accordance with a tenth example embodiment.
Figure 13B:
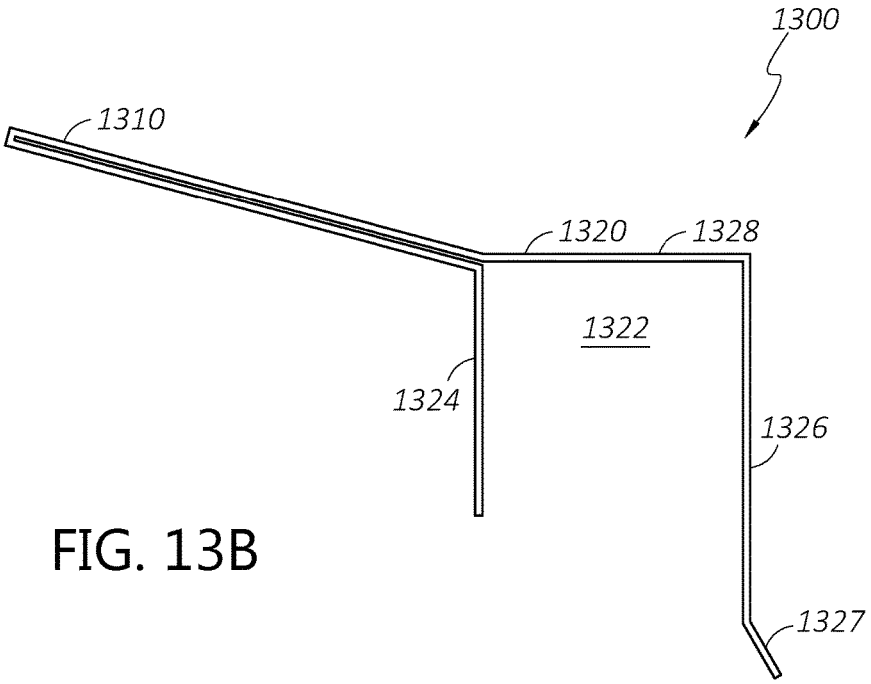
FIG. 13B is a side profile view of the roof drip edge of FIG. 13A.

FIGS. 13A and 13B depict an alternative configuration of a drip edge 1300 in which the outer footing 1326 terminates in an angled section 1327 comprising a single layer, rather than a folded double-layer angled section (e.g., the angled section 1027 of FIG. 10D). In some embodiments, the single-layer angled section 1327 may reduce the amount of material required to form the angled section 1327. For example, if the drip edge 1300 is formed by bending sheet metal having a standard width, the single-layer angled section 1327 may free up a portion of the sheet metal width equal to the length of the angled section 1327, which may be allocated to additional length in another portion of the profile of the drip edge 1300 (e.g., to lengthen the tail 1310, widen the c-shaped channel 1322, etc.).

Figure 14A:
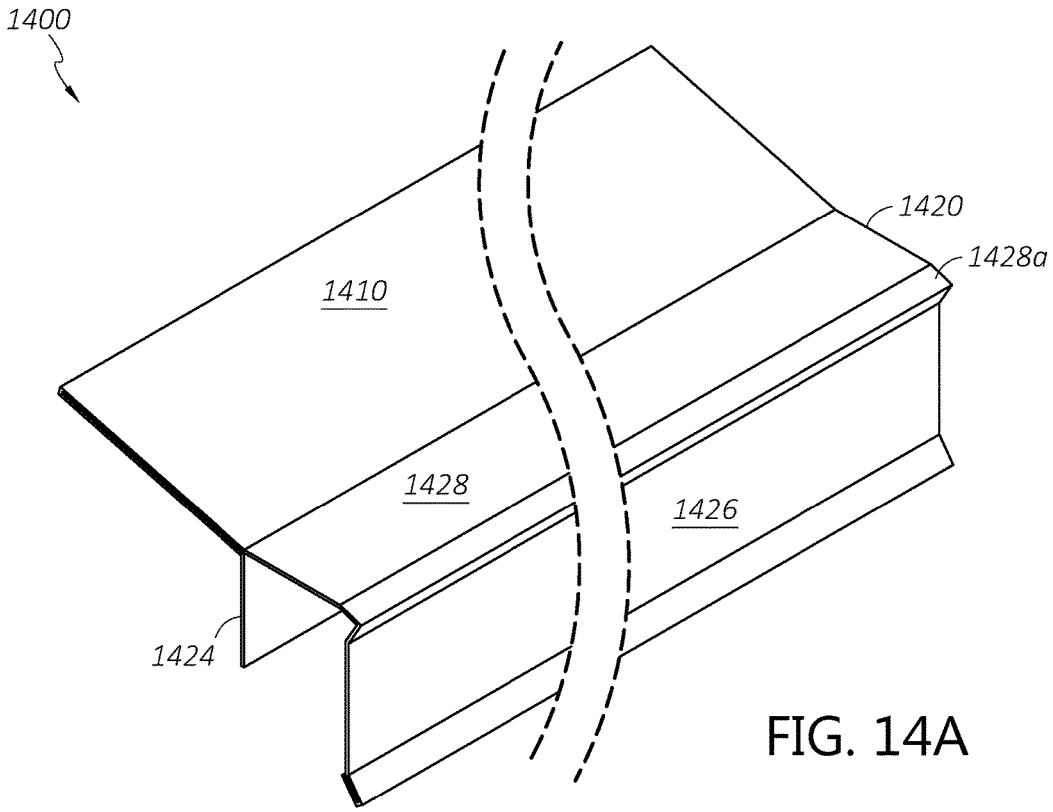
FIG. 14A is an isometric perspective view of a roof drip edge in accordance with an eleventh example embodiment.
Figure 14B:
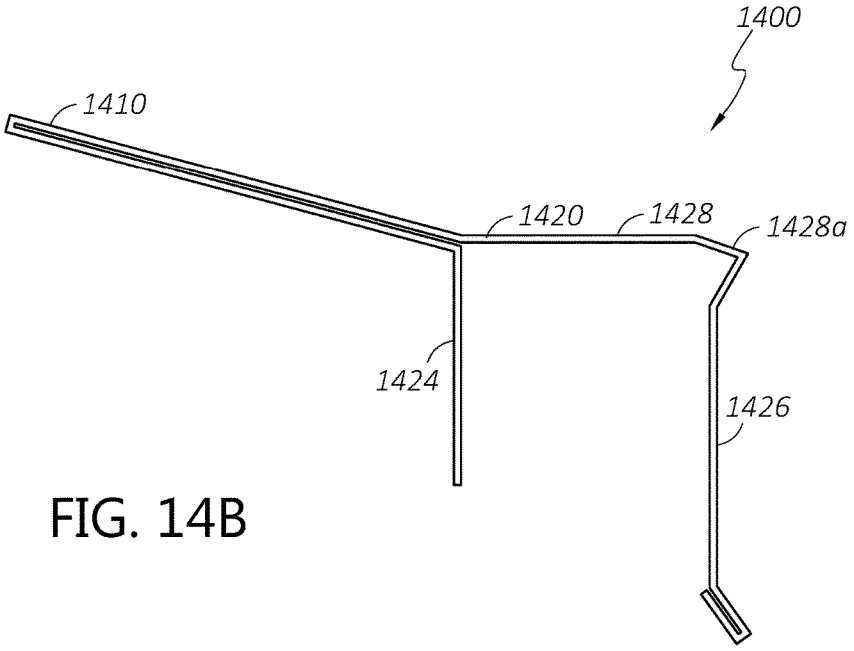
FIG. 14B is a side profile view of the roof drip edge of FIG. 14A.

FIGS. 14A and 14B depict an alternative configuration of a drip edge 1400 similar to the drip edge 1200. In the configuration of FIGS. 14A and 14B, a distal section 1428*a* of the bridging member 1428 extends at a relatively shallow downward angle, such as between 5 degrees and 20 degrees, relative to the remainder of the bridging member 1428. The downward slope of the distal section 1428*a* of the bridging member 1428 may further aid in facilitating drainage of water, as gravity may tend to pull water along the distal portion 1428*a* away from the building.

Figure 15A:
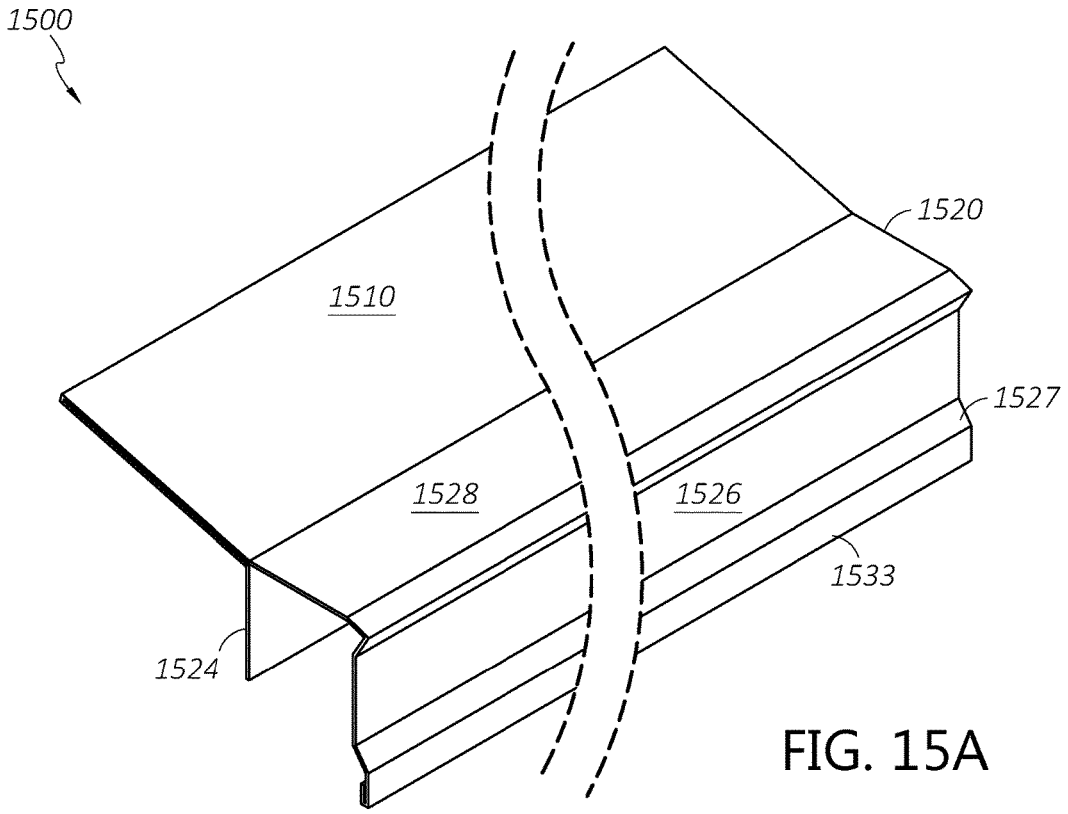
FIG. 15A is an isometric perspective view of a roof drip edge in accordance with a twelfth example embodiment.
Figure 15B:
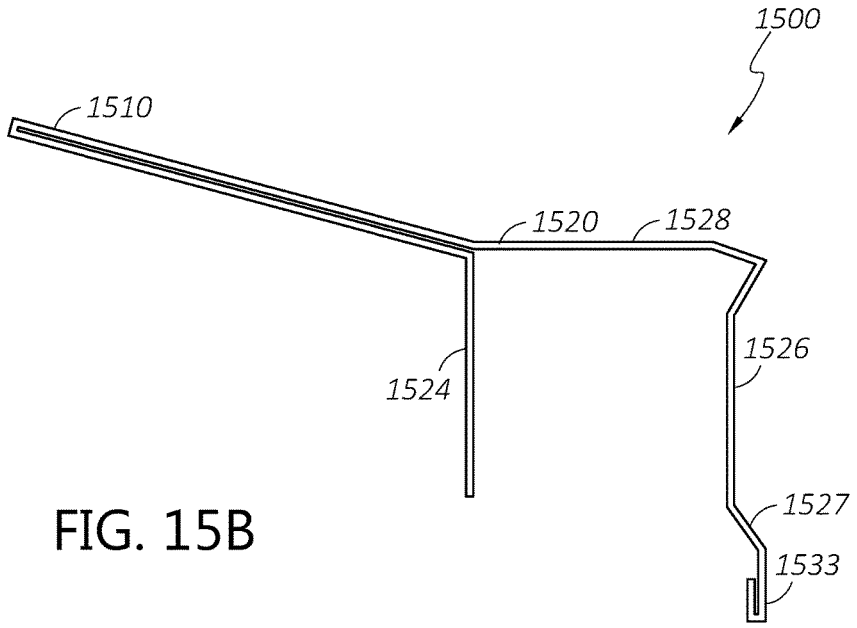
FIG. 15B is a side profile view of the roof drip edge of FIG. 15A.

FIGS. 15A and 15B depict an alternative configuration of a drip edge 1500 in which the outer footing 1526 comprises an angled section 1527 near the distal end of the outer footing 1526, as well as a second vertical section 1533 disposed distal to the angled section 1527. In some aspects, the second vertical section 1533 below the angled section 1527 may facilitate the coalescence of water traveling to the end of the angled section 1527.

FIGS. 16A and 16B depict an alternative configuration of a drip edge 1600 generally similar to the drip edges 1000, 1100 depicted in FIGS. 10A-11D, with an angle of 180 degrees at the upper angled joint 1630 between the upper layer 1613 of the tail 1610 and the bridging member 1628. Accordingly, the bridging member 1628, upper layer 1613, and lower layer 1611 are disposed at a similar downward angle relative to the ground, equal to the roof pitch angle. In some embodiments, the 180-degree upper angled joint 1630 and downward slope of the bridging member 1628 may further enhance drainage of water from the roof away from the building. The downward-sloping bridging member 1628 may additionally result in a trapezoidal c-shaped channel 1622 and the installation of a fascia board may leave a corresponding triangular air gap between the top of the fascia board and the bridging member 1628.

Figure 17:
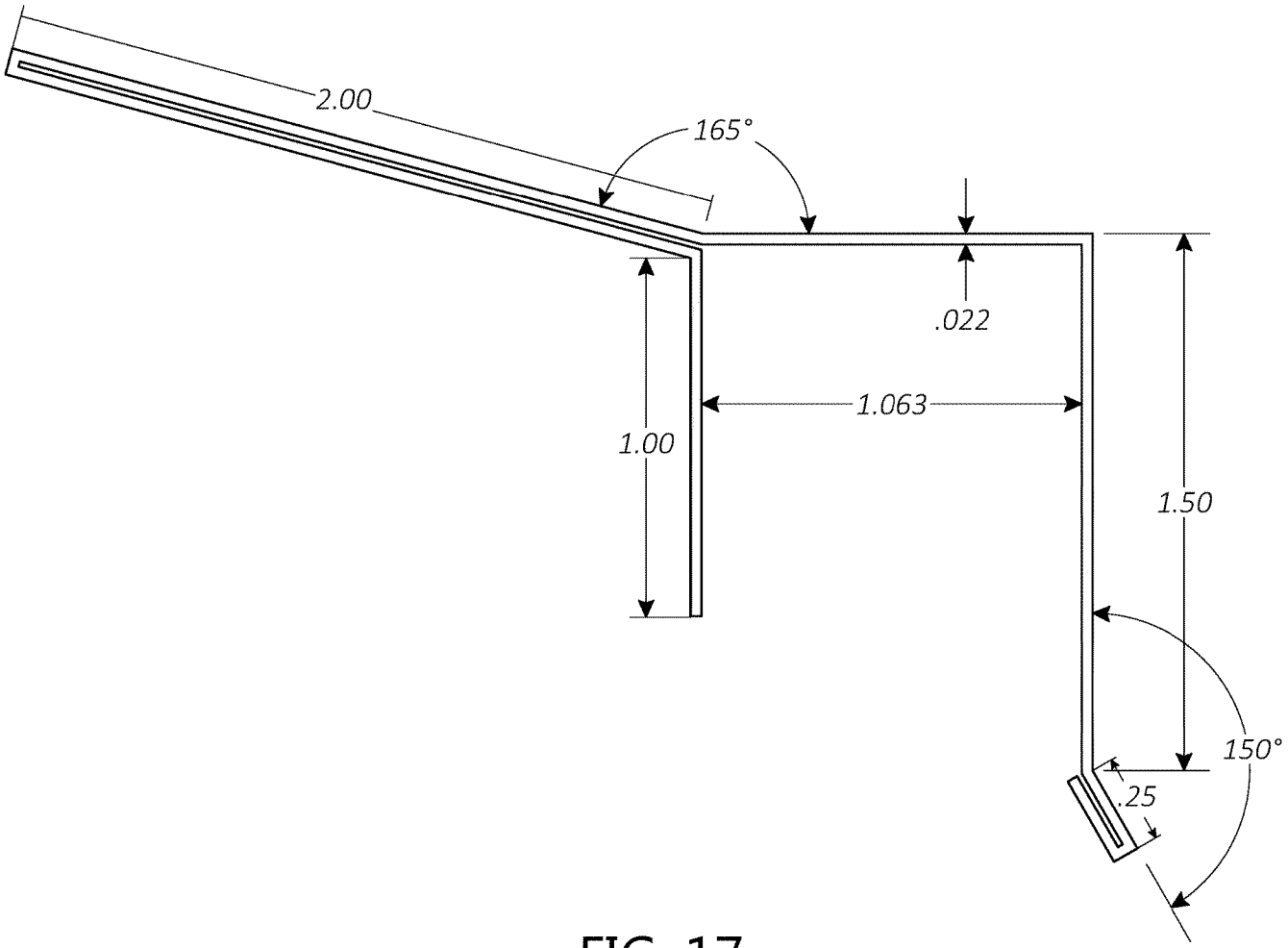
FIG. 17 is a side profile view of a roof drip edge in accordance with a further example embodiment.

FIG. 17 is a side profile view showing example dimensions of one embodiment of a drip edge having a side profile similar to the side profile of drip edge 1000 depicted in FIGS. 10A-10D. In the embodiment shown in FIG. 17, each layer of the tail has a width of 2.00 inches (50.8 mm). The inner footing has a length of 1.00 inch (25.4 mm). The c-shaped channel has a width of 1.063 inches (27 mm) as defined by the length of the bridging member. The outer footing extends downward 1.50 inches (38.1 mm) vertically from the bridging member, with a double-layer angled section having a length of 0.25 inches (6.35 mm). The angle between the upper layer of the tail and the bridging member is 165 degrees. Accordingly, the dimensions of the drip edge in FIG. 17 may permit this particular drip edge embodiment to be formed by bending and/or rolling from sheet metal having a width of 8 inches (203.2 mm).

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Although making and using various embodiments are discussed in detail, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. An integrally formed universal drip edge comprising:

a tail extending along a length of the drip edge, the tail comprising a lower layer and an upper layer contiguous with the lower layer at a bendable longitudinal tail joint extending along the length of the drip edge at an upper end of the tail;

an inner footing extending along the length of the drip edge and integrally formed with the lower layer at a lower end of the tail; and an outer section extending along the length of the drip edge and comprising:

a bridging member having a proximal end integrally formed with the upper layer at the lower end of the tail to define a roof angle; and an outer footing parallel to the inner footing and integrally formed with a distal end of the bridging member opposite the proximal end;

wherein the roof angle is selectable by bending at least one of the inner footing and the bridging member relative to the tail;

wherein the inner footing comprises an inner surface proximate the lower layer, the inner surface configured to be placed against an end surface of a roof substrate to define a drip edge installation position; and wherein the bridging member, the inner footing, and the outer footing define a downward-facing channel configured to receive and partially surround a fascia board.

2. The drip edge of claim 1, wherein the bridging member meets the upper layer of the tail along a bendable upper angled joint.

3. The drip edge of claim 1, wherein the inner footing meets the lower layer of the tail along a bendable lower angled joint.

4. The drip edge of claim 1, wherein a lower angle between the inner footing and the lower layer of the tail is adjustable, and wherein an upper angle between the bridging member and the upper layer of the tail is adjustable independently of the lower angle.

5. The drip edge of claim 1, wherein the bridging member and the upper layer of the tail define an upper angled joint having an angle of between 135 degrees and 180 degrees.

6. The drip edge of claim 1, wherein the tail is configured to receive one or more mechanical fasteners for securing the drip edge to a roof substrate.

7. The drip edge of claim 1, wherein the outer footing comprises a top end integrally formed with the bridging member and a bottom end opposite the top end, the bottom end comprising a lip disposed at an angle relative to the outer footing.

8. The drip edge of claim 7, wherein the bottom end comprises a double layer terminating in a joint.

9. The drip edge of claim 1, wherein the inner footing, the outer section, and the tail comprise aluminum.

10. The drip edge of claim 9, wherein the outer section and the tail are manufactured by bending to form an integral drip edge system.

11. The drip edge of claim 9, wherein the aluminum is sheet aluminum having a thickness not greater than 21 gauge and not less than 26 gauge.

12. The drip edge of claim 1, wherein the outer footing is configured to accommodate and direct a flow of water received from a roof.

13. The drip edge of claim 1, wherein the c-shaped channel is sized and shaped to allow the fascia board to be installed to the roof substrate after the drip edge is installed to the roof substrate.

* * * * *